US012708821B2

(12) United States Patent
Stokke et al.

(10) Patent No.: US 12,708,821 B2
(45) Date of Patent: Aug. 18, 2026

(54) GOLF CLUB HEAD WITH TRANSITION PROFILES TO REDUCE AERODYNAMIC DRAG

(71) Applicant: KARSTEN MANUFACTURING CORPORATION, Phoenix, AZ (US)

(72) Inventors: Ryan M. Stokke, Anthem, AZ (US); Sina Ghods, Scottsdale, AZ (US); Cory S. Bacon, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 967 days.

(21) Appl. No.: 17/900,782

(22) Filed: Aug. 31, 2022

(65) Prior Publication Data

US 2023/0001272 A1 Jan. 5, 2023

Related U.S. Application Data

(63) Continuation-in-part of application No. 17/094,695, filed on Nov. 10, 2020, now Pat. No. 11,541,284, which is a continuation of application No. 16/022,424, filed on Jun. 28, 2018, now Pat. No. 10,828,539, which is a continuation of application No. 15/233,486, filed on Aug. 10, 2016, now Pat. No. 10,035,048.

(60) Provisional application No. 63/240,214, filed on Sep. 2, 2021, provisional application No. 62/365,889, filed on Jul. 22, 2016, provisional application No. 62/204,911, filed on Aug. 13, 2015.

(51) Int. Cl.
*A63B 53/04* (2015.01)

(52) U.S. Cl.
CPC ..... *A63B 53/0466* (2013.01); *A63B 53/0408* (2020.08); *A63B 53/0433* (2020.08); *A63B 53/0437* (2020.08); *A63B 2225/01* (2013.01)

(58) Field of Classification Search
CPC ..... A63B 53/0466; A63B 53/0408; A63B 53/0433; A63B 53/0437; A63B 2225/01
See application file for complete search history.

(56) References Cited

U.S. PATENT DOCUMENTS

| | | | |
|---|---|---|---|
| 3,985,363 | A | 10/1976 | Jepson et al. |
| 5,398,935 | A | 3/1995 | Katayama |
| 6,048,278 | A | 4/2000 | Meyer et al. |
| 7,530,901 | B2 | 5/2009 | Imamoto et al. |
| 7,785,214 | B2 | 8/2010 | Horacek et al. |
| 8,182,366 | B2 | 5/2012 | Horacek et al. |
| 8,241,142 | B2 | 8/2012 | Evans et al. |
| 8,317,636 | B2 | 11/2012 | Evans et al. |
| 8,845,453 | B1 | 9/2014 | Ehlers |
| 8,858,359 | B2 | 10/2014 | Willett et al. |
| 8,864,601 | B1 | 10/2014 | Ehlers |

(Continued)

OTHER PUBLICATIONS

International Search Report and Written Opinion dated Oct. 28, 2016 from corresponding PCT Application No. PCT/US2016/46337, filed Aug. 10, 2016.

*Primary Examiner* — Michael D Dennis

(57) ABSTRACT

Embodiments of golf club heads having transition profiles to reduce aerodynamic drag during a swing are described herein. In some embodiments, a golf club head includes a crown transition profile having a first crown radius of curvature, a sole transition profile having a first sole radius of curvature, and a rear transition profile having a rear radius of curvature.

14 Claims, 16 Drawing Sheets

(56) References Cited

U.S. PATENT DOCUMENTS

| | | | | |
|---|---|---|---|---|
| 9,144,722 | B2 | 9/2015 | Schweigert et al. | |
| 9,278,266 | B2 | 3/2016 | Burnett et al. | |
| 9,504,886 | B2 | 11/2016 | Albertsen et al. | |
| 9,662,545 | B2 | 5/2017 | Beach et al. | |
| 9,750,991 | B2 | 9/2017 | Chao et al. | |
| 2010/0016096 | A1* | 1/2010 | Burnett | A63B 53/0466 473/345 |
| 2011/0247190 | A1* | 10/2011 | Evans | A63B 53/0466 29/407.01 |
| 2012/0322578 | A1* | 12/2012 | Ban | A63B 53/0466 473/345 |
| 2017/0043222 | A1* | 2/2017 | Stokke | A63B 53/0466 |

* cited by examiner

GOLF CLUB HEAD WITH TRANSITION PROFILES TO REDUCE AERODYNAMIC DRAG

CROSS REFERENCE TO RELATED APPLICATIONS

This claims the benefit of U.S. Provisional Patent Application No. 63/240,214, filed on Sep. 2, 2021, and is a continuation-in-part of U.S. patent application Ser. No. 17/094,695, filed on Nov. 10, 2020, which is a continuation of U.S. patent application Ser. No. 16/022,424, filed on Jun. 28, 2018, and is issued as U.S. Pat. No. 10,828,539 on Nov. 10, 2020, which is a continuation of U.S. patent application Ser. No. 15/233,486, filed on Aug. 10, 2016, and is issued as U.S. Pat. No. 10,035,048 on Jul. 31, 2018, which claims priority to U.S. Provisional Patent Application No. 62/365,889, filed on Jul. 22, 2016, and U.S. Provisional Patent Application No. 62/204,911, filed on Aug. 13, 2015. The contents of all the above-described disclosures are incorporated fully herein by reference in their entirely.

FIELD OF INVENTION

The present disclosure relates to golf club heads. In particular, the present disclosure is related to golf club heads having transition regions to reduce aerodynamic drag during a swing.

BACKGROUND

Golf club manufacturers have designed golf club heads with aerodynamic features to improve the flow of air over and around the golf club head. When air flows around a golf club head during a swing, a wake, or an area of disturbed air flow, is formed behind the club head. In many cases, the wake creates a drag force on the club head, thereby slowing the speed of the golf club head throughout the swing. The transition profiles of a golf club head can be a large contributor to the drag forces on the club head during a swing. Therefore, there is a need in the art for a golf club head having transition regions to reduce the aerodynamic drag on the club head during a swing.

Figure 1:
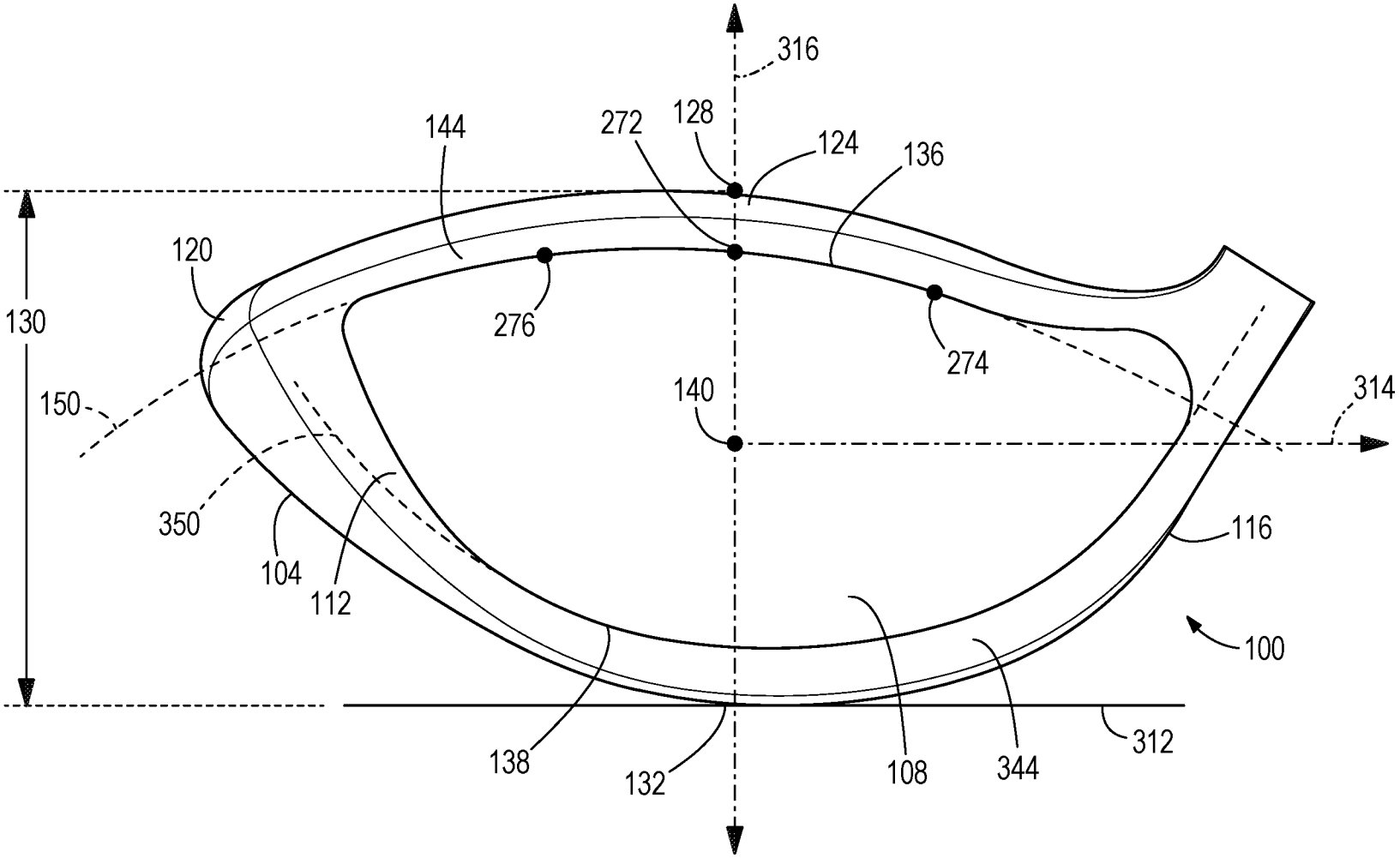
FIG. 1 is a front view of an exemplary golf club head according to a first embodiment.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

Described herein are embodiments of a golf club head including various transition profiles to reduce aerodynamic drag on the club head during a swing. Transition profiles contribute significantly to the aerodynamic drag on the golf club head. In many embodiments, the club head includes a crown transition profile, a sole transition profile, and a rear transition profile to maximize the reduction of drag resulting from the transition regions of the club head. Specifically, the crown transition profile extends between a top edge of the strike face and an apex of the crown. The crown transition profile includes a first crown radius of curvature between the top edge of the strike face and a first crown transition point, and a major crown transition point positioned between the first crown transition point and the apex. The crown transition profile further includes a plurality of crown radii of curvature and crown transition points between the first crown transition point and the crown apex.

The crown radii of curvature of the crown transition profile between the top edge of the strike face and the major crown transition point contribute significantly to the aerodynamic drag of the golf club head. The crown radii of curvature of the crown transition profile between the top edge of the strike face and the major crown transition point are between 0.18 inch to 2.0 inches. Crown radii of curvature less than 2.0 inches (i.e. smaller radii of curvature) forward the major crown transition point reduce the aerodynamic drag the greatest. Further, crown radii of curvature less than 1.0 inches forward of the major crown transition point reduce the aerodynamic drag the greatest. These crown radii of curvature form a crown transition profile shape of a quick ramp up to the major crown transition point, then flatter near the apex.

The crown transition profile shape (i.e. quick ramp up to the major crown transition point, then flatter near the apex) creates a larger crown transition region, which allows air to move away faster from strike face. Moving air away faster from the strike face reduces aerodynamic drag on the crown. Club heads comprising the crown transition profile including 1) the first crown radius of curvature between 0.18 inch and 0.30 inch, 2) crown radii of curvature less than 2.0 inches forward the major crown transition point, and 3) the plurality of crown radii of curvature and the plurality of crown transition points between the first crown transition point and the crown apex provide desirable aerodynamic drag reduction.

Further, in other embodiments, the club head includes a crown transition profile, a sole transition profile, and a rear transition profile to maximize the reduction of drag resulting from the transition regions of the club head. In many embodiments, the crown transition profile includes a first crown radius of curvature between approximately 0.18-0.30 inches (0.46-0.76 cm), the sole transition profile includes a first sole radius of curvature between approximately 0.3-0.5 inches (0.76-1.27 cm), and the rear transition profile includes a rear radius of curvature between approximately 0.10-0.25 inches (0.25-0.64 cm) to reduce aerodynamic drag on the club head.

Various embodiments of the golf club head are described herein having transition regions to reduce aerodynamic drag include a golf club head having a body and a strike face. The strike face includes a top edge, a bottom edge, and a geometric center. The strike face defines a loft plane positioned tangent to the strike face extending through the geometric center. The body includes a front end, a back end opposite the front end, a heel, a toe opposite the heel, a crown having an apex and a crown transition profile, a sole having a lowest point and a sole transition profile, and a back end or skirt having rear transition profile. The crown transition profile includes a first crown radius of curvature extending from the top edge of the strike face to a first crown transition point, wherein the first crown radius of curvature is between approximately 0.18 inches and 0.30 inches (0.46 cm-0.76 cm). The sole transition profile includes a first sole radius of curvature extending from the bottom edge of the strike face to a first sole transition point, wherein the first sole radius of curvature is between approximately 0.30 inches and 0.50 inches (0.76 cm-1.27 cm). The rear transition profile includes a rear radius of curvature between approximately 0.10 inches and 0.25 inches (0.25 cm-0.64 cm).

Some embodiments include a golf club comprising a golf club head and a shaft coupled to the golf club head. The club head includes a body and a strike face. The strike face includes a top edge, a bottom edge, and a geometric center. The strike face defines a loft plane positioned tangent to the strike face extending through the geometric center. The body includes a front end, a back end opposite the front end, a heel, a toe opposite the heel, a crown having an apex and a crown transition profile, a sole having a lowest point and a sole transition profile, and a back end or skirt having rear transition profile. The crown transition profile includes a first crown radius of curvature extending from the top edge of the strike face to a first crown transition point, wherein the first crown radius of curvature is between approximately 0.18 inches (0.46 cm) and 0.30 inches (0.76 cm). The sole transition profile includes a first sole radius of curvature extending from the bottom edge of the strike face to a first sole transition point, wherein the first sole radius of curvature is between approximately 0.30 inches (0.76 cm) and 0.50 inches (1.27 cm). The rear transition profile includes a rear radius of curvature between approximately 0.10 inches (0.25 cm) and 0.25 inches (0.64 cm).

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

As defined herein, "spline method" refers to a method of determining the location where the curvature of a surface changes. For example, the spline method can be used to determine where the curvature of the front end of a club head deviates from the bulge and roll of the strike face. The spline method can be implemented by imposing a spline onto the curved surface with an interval such that the spline indicates where a significant change in curvature begins.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 2:
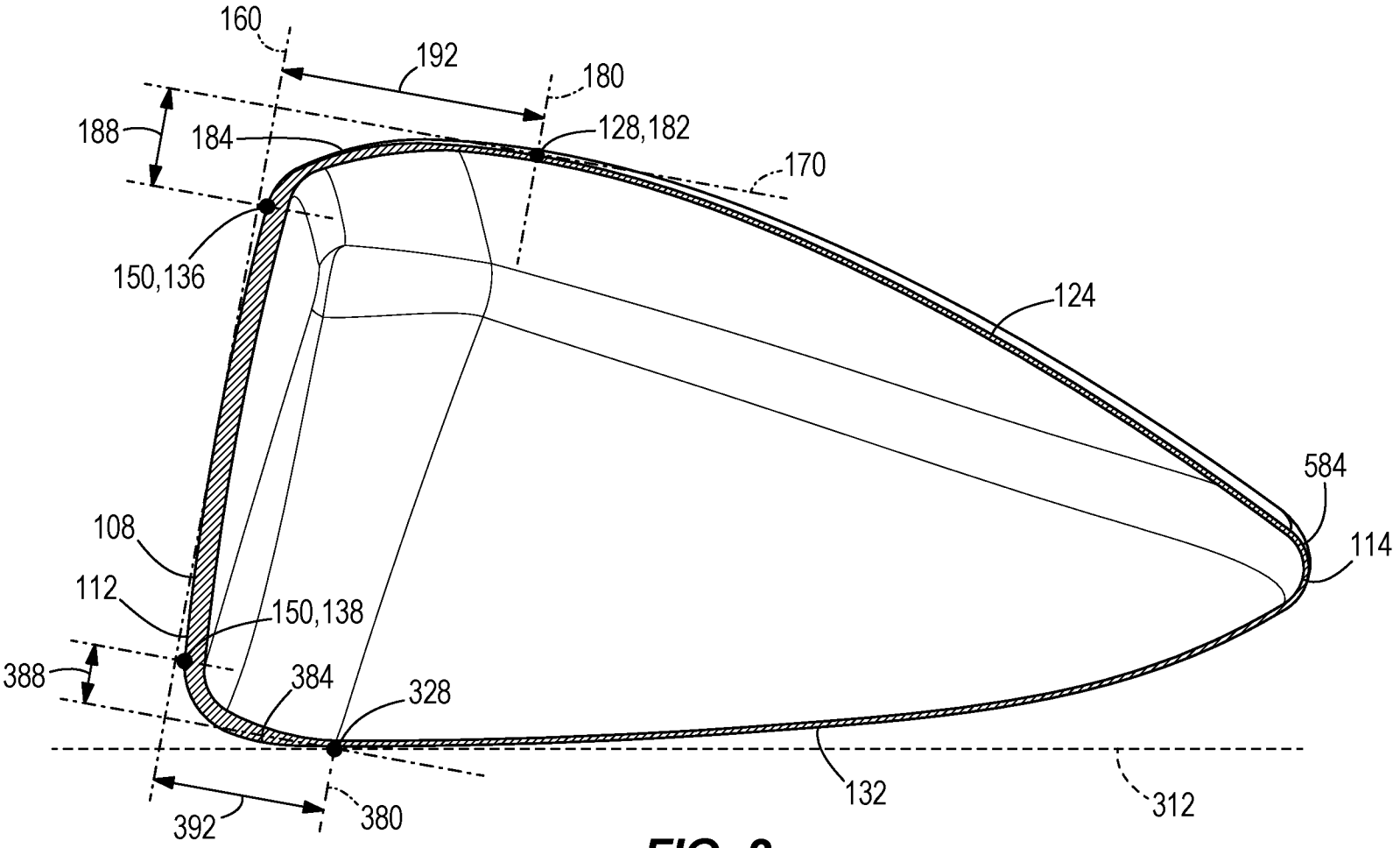
FIG. 2 is a side, cross sectional view of the golf club head in FIG. 1.

FIGS. 1-2 illustrate a golf club head 100 including a body 104 and a strike face 108. The body 104 includes a front end 112, a back end 114 opposite the front end 112, a heel 116, a toe 120 opposite the heel 116, a crown 124 having an apex 128, and a sole 132 opposite the crown 124.

Referring to FIG. 1, the strike face 108 includes a top edge 136, a bottom edge 138, and a geometric center 140. The top edge 136 extends along the front end 112 of the strikeface 108 near the crown 124 where the curvature deviates from the bulge and roll of the strike face 108. The bottom edge 138 extends along the front end 112 of the strikeface 108 near the sole 132 where the curvature deviates from the bulge and roll of the strike face 108. In some embodiments, the spline method can be used to determine where the curvature deviates from the bulge and roll of the strike face 108 at the top edge 136 or at the bottom edge 138.

The geometric center 140 of the strike face 108 can be located at a geometric midpoint of the strike face 108. In the same or other examples, the geometric center 140 also can be centered with respect to an engineered impact zone, which can be defined by a region of grooves of the strike face 108. As another approach, the geometric center 140 of the strike face 108 can be located in accordance with the definition of a golf governing body such as the United States Golf Association (USGA). For example, geometric center 140 of the strike face 108 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

Figure 3:
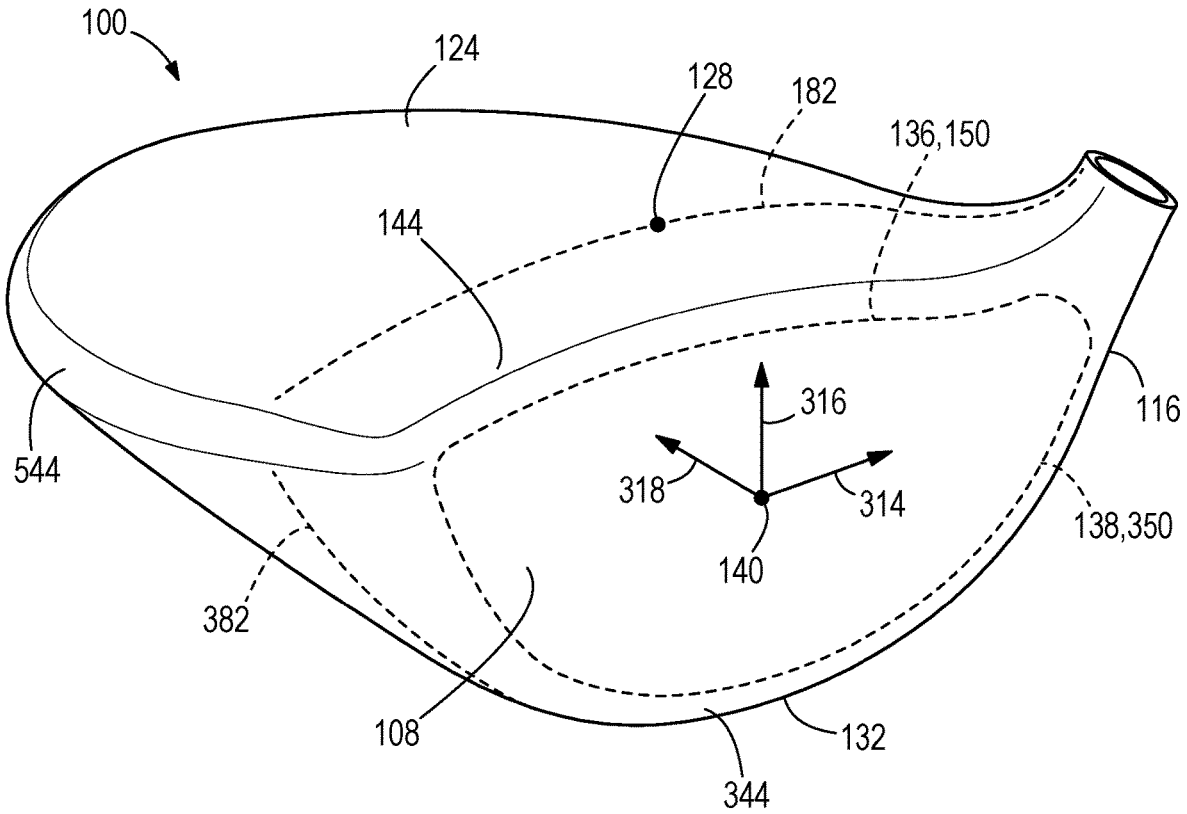
FIG. 3 is a front prospective view of the golf club head in FIG. 1.

Further referring to FIG. 1, the geometric center 140 of the strike face 108 defines an origin of a coordinate system having an x-axis 314, a y-axis 316, and a z-axis 318 (FIG. 3). The x-axis 314 extends through the geometric center 140 of the strike face 108 from near the heel 116 to near the toe 120 of the club head 100 in a direction parallel to the ground plane 312. The y-axis 316 extends through the geometric center 140 of the strike face 108 from near the crown 124 to near the sole 132 of the club head 100 in a direction perpendicular to the ground plane 312. The z-axis 318 (FIG. 3) extends through the geometric center 140 of the strike face 108 from the front end 112 to the back end 114 of the club head 100 in a direction parallel to the ground plane 312.

The golf club head 100 described herein may be any type of golf club head. In the illustrated embodiment, the golf club head is illustrated as a driver-type golf club head. In other embodiments, the golf club head may be a wood-type golf club head, a hybrid-type golf club head, an iron-type golf club head, or any other type of golf club head. Further, the golf club head 100 described herein may be part of a golf club having a shaft and a grip (not shown).

FIGS. 1-2 illustrate the club head 100 in an address position relative to a ground plane 312. In the address position, a hosel axis, extending centrally through the hosel, is positioned at a 60 degree angle to the ground plane when viewed from a front view (FIG. 1). Further, the club head 100 includes a loft plane 160 that extends tangent to the geometric center 140 of the strike face 108, and a plurality of transition regions including a crown transition region 144, a sole transition region 344, and a rear transition region 544, described in further detail below.

I. Crown Transition Region

Referring to FIG. 1, the crown transition region 144 extends between the strike face 108 and the crown 124 of the club head 100, from near the heel 116 to near the toe 120. The crown transition region 144 of the golf club head 100 is further described herein in relation to various reference planes and axes, as described below.

Further referring to FIG. 1, the golf club head 100 includes a curved axis 150 that extends along the front end 112 of the body 104 from the heel 116 to the toe 120. In the illustrated embodiment, the curved axis 150 extends along the top edge 136 of the strike face 108. In other embodiments, the curved axis 150 may be offset from the top edge 136 of the strike face 108 toward the crown 124. The curved axis 150 may be offset from the top edge 136 of the strike face 108 by a constant distance moving from the heel 116 to the toe 120, or the curved axis 150 may be offset from the top edge 136 of the strike face 108 by a varying distance moving from the heel 116 to the toe 120. For example, the curved axis 150 may be offset from the top edge 136 of the strike face 108 by a greater or lesser distance near the center, the heel 116, the toe 120, or any combination of the described positions on the club head 100.

Referring to FIGS. 2 and 3, the golf club head 100 further includes a crown plane 170 and an apex plane 180. The crown plane 170 extends through the apex 128 of the crown 124 perpendicular to the loft plane 160. The apex plane 180 extends through the apex 128 of the crown 124 parallel to the loft plane 160. The intersection of the apex plane 180 with the crown 124 of the club head 100 further defines a curved crown axis 182.

Referring to FIGS. 1-2, the crown transition region 144 extends from the top edge 136 on the front end 112 of the club head 100 to the apex plane 180, along the crown 124 of the club head 100. The crown transition region 144 includes a crown transition profile 184 when viewed from a side cross sectional view taken along a plane defined by the y-axis 316 and z-axis 318 (FIG. 3). In these embodiments, the side cross sectional view of the crown transition profile 184 can be taken at any point along the club head 100 from near the heel 116 to near the toe 120.

i. Height and Length of the Crown Transition Profile

Referring to FIGS. 2 and 3, the crown transition profile 184 includes a height 188 and a length 192. The height 188 of the crown transition profile 184 is the distance from the top edge 136 to the crown axis 182 in a direction parallel to the loft plane 160. The length 192 of the crown transition profile 184 is the perpendicular distance from the loft plane 160 to the apex plane 180.

Referring to FIG. 2, in the illustrated embodiment, the length 192 of the crown transition profile 184 ranges from approximately 1.13-1.34 inches (2.87-3.4 cm). In other embodiments, the length 192 of the crown transition profile 184 may range from 0.90-1.75 inches (2.29-4.45 cm). For example, the length 192 of the crown transition profile 184 may be approximately 0.90 inches (2.29 cm), 0.95 inches (2.41 cm), 1.00 inches (2.54 cm), 1.05 inches (2.67 cm), 1.10 inches (2.79 cm), 1.15 inches (2.92 cm), 1.20 inches (3.05 cm), 1.25 inches (3.18 cm), 1.30 inches (3.30 cm), 1.35 inches (3.43 cm), 1.40 inches (3.56 cm), 1.45 inches (3.68 cm), 1.50 inches (3.81 cm), 1.55 inches (3.94 cm), 1.60 inches (4.06 cm), 1.65 inches (4.19 cm), 1.70 inches (4.32 cm), or 1.75 inches (4.45 cm).

Further referring to FIG. 2, in the illustrated embodiment, the height 188 of the crown transition profile 184 ranges from approximately 0.410-0.470 inches (1.04-1.19 cm). In other embodiments, the height 188 of the crown transition profile 184 may range from 0.30-0.60 inches (0.76-1.52 cm). For example, the height 188 of the crown transition profile 184 may be approximately 0.30 inches (0.076 cm), 0.35 inches (0.89 cm), 0.40 inches (1.02 cm), 0.45 inches (1.14 cm), 0.50 inches (1.27 cm), 0.55 inches (1.40 cm), or 0.60 inches (1.52 cm).

The club head 100 further includes a first ratio of the length 192 to the height 188 of the crown transition profile 184. In the illustrated embodiment, the first ratio of the crown transition profile 184 ranges from approximately 2.75-3.0. In other embodiments, the first ratio of the crown transition profile 184 may range from approximately 2.5-3.25. Further, in other embodiments, the first ratio of the crown transition profile 184 may be any value less than approximately 3.50, less than approximately 3.25, or less than approximately 3.0. For example, the first ratio of the crown transition profile 184 may be less than or equal to approximately 3.50, 3.25, 3.00, 2.75, or 2.50.

The aerodynamic drag on a club head decreases as the first ratio of the crown transition profile approaches a value of 1.0 (i.e. as the length of the crown transition profile approaches the height of the crown transition profile, or as the height of the crown transition profile approaches the length of the crown transition profile). The first ratio of the crown transition profile 184 of the club head 100 described herein is less than the first ratio of the crown transition profile of other known golf club heads. Therefore, the club head 100 described herein has less aerodynamic drag, and therefore increased swing speeds and ball distance than other known golf club heads.

ii. Transition Points and Radii of Curvature of the Crown Transition Profile According to a First Embodiment Referring to FIG. 4, the crown transition profile 184 further includes more than one radius of curvature and more than one transition point. The transition points indicate a change in the radius of curvature of the crown transition profile 184. In the illustrated embodiment, the crown transition profile 184 includes a first crown transition point 212, a second crown transition point 222, a first crown radius of curvature 214, and a second crown radius of curvature 224. The first crown transition point 212 is offset from the loft plane 160 by a first offset distance 216. The second crown transition point 222 is offset from the loft plane 160 by a second offset distance 226. The second offset distance 226 is greater than the first offset distance 216. The second offset distance 226 is less than the crown transition profile length 192. The second offset distance 226 is less than a distance the crown apex 128 is offset from the loft plane 160 or an apex distance as described below. The first crown radius of curvature 214 extends from the top edge 136 to the first crown transition point 212. The second crown radius of curvature 224 extends from the first crown transition point 212 to the second crown transition point 222.

Figure 4:
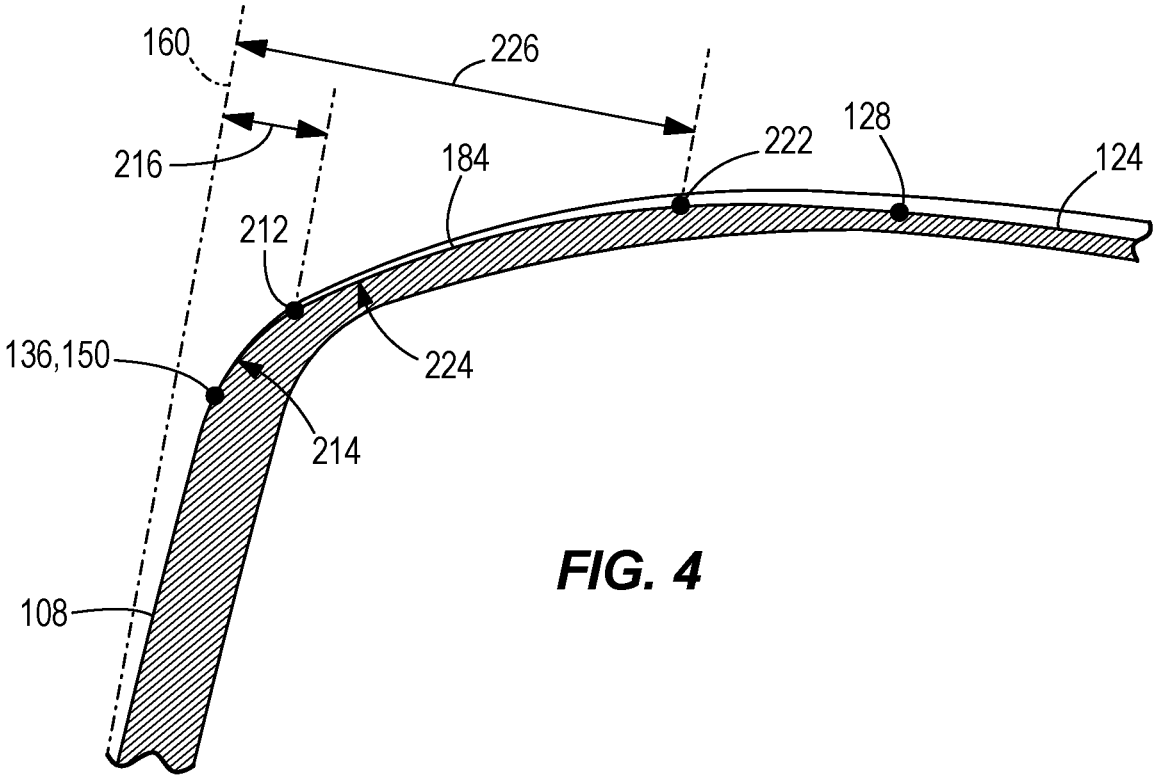
FIG. 4 is an enlarged side, cross sectional view of the crown transition profile of the golf club head in FIG. 1.

Referring to FIG. 4, in the illustrated embodiment, the first offset distance 216 and the second offset distance 226 are substantially constant from the heel 116 to the toe 120 of the club head 100. In other embodiments, the first offset distance 216 may vary from the heel 116 to the toe 120 of the club head 100. For example, the first offset distance 216 may be greater toward the heel 116 of the club head 100, toward the toe 116 of the club head 100, in the center of the club head 100, or in any combination of the above described positions. The first offset distance 216 may vary from the heel 116 to the toe 120 according to any profile, such as, for example, linear, parabolic, quadratic, exponential, or any other profile.

The first offset distance 216 can range from approximately 0.08 to 0.2 inch. In other embodiments, the first offset distance 216 can range from 0.08 to 0.18 inch, 0.09 to 0.19 inch, or 0.1 to 0.2 inch. For example, the first offset distance 216 can be 0.08, 0.09, 0.10, 0.11, 0.12, 0.13, 0.14, 0.15, 0.16, 0.17, 0.18, 0.19, or 0.20 inch.

In other embodiments, the second offset distance 226 may vary from the heel 116 to the toe 120 of the club head 100. For example, the second offset distance 226 may be greater toward the heel 116 of the club head 100, toward the toe 120 of the club head 100, in the center of the club head 100, or in any combination of the above described positions. The second offset distance 226 may vary from the heel 116 to the toe 120 according to any profile, such as, for example, linear, parabolic, quadratic, exponential, or any other profile.

The second offset distance 226 can be less than 0.7 inch, less than 0.65 inch, less than 0.6 inch, less than 0.55 inch, less than 0.5 inch, less than 0.45 inch, less than 0.40 inch, less than 0.35 inch, less than 0.3 inches, or less than 0.25 inch. In other embodiments, the second offset distance 226 can range from approximately 0.2 to 0.7 inch. In other embodiments, the second offset distance 226 can range from 0.2 to 0.5 inch, or 0.5 to 0.7 inch. In other embodiments still, the second offset distance 226 can range from 0.2 to 0.4 inch, or 0.4 to 0.7 inch. For example, the second offset distance 226 can be 0.2, 0.25, 0.3, 0.35, 0.4, 0.45, 0.5, 0.55, 0.6, 0.65, or 0.7.

In the illustrated embodiment, the crown transition profile 184 has a first crown radius of curvature 214 of approximately 0.24 inches (0.61 cm). In other embodiments, the first crown radius of curvature 214 may range from approximately 0.18 to 0.30 inches (0.46 to 0.76 cm). Further, in other embodiments, the first crown radius of curvature 214 can be less than 0.40 inches (1.02 cm), less than 0.375 inches (0.95 cm), less than 0.35 inches (0.89 cm), less than 0.325 inches (0.83 cm), or less than 0.30 inches 0.76 cm). For example, the first crown radius of curvature 214 may be approximately 0.18 inches (0.46 cm), 0.20 inches (0.51 cm), 0.22 inches (0.66 cm), 0.24 inches (0.61 cm), 0.26 inches (0.66 cm), 0.28 inches (0.71 cm), or 0.30 inches (0.76 cm).

Referring to FIG. 4, in the illustrated embodiment, the first crown radius of curvature 214 and the second crown radius of curvature 224 are substantially constant from the heel 116 to the toe 120 of the club head 100. In other embodiments, the first crown radius of curvature 214 may vary from the heel 116 to the toe 120 of the club head 100. For example, the first crown radius of curvature 214 may be greater toward the heel 116 of the club head 100, toward the toe 120 of the club head 100, in the center of the club head 100, or in any combination of the above described positions. The first crown radius of curvature 214 may vary from the heel 116 to the toe 120 according to any profile, such as, for example, linear, parabolic, quadratic, exponential, or any other profile.

Further, in other embodiments, the second crown radius of curvature 224 may vary from the heel 116 to the toe 120 of the club head 100. For example, the second crown radius of curvature 224 may be greater toward the heel 116 of the club head 100, toward the toe 120 of the club head 100, in the center of the club head 100, or in any combination of the above described positions. The second crown radius of curvature 224 may vary from the heel 116 to the toe 120 according to any profile, such as, for example, linear, parabolic, quadratic, exponential, or any other profile.

In the illustrated embodiment, the crown transition profile 184 has two transition points and two radii of curvature. In other embodiments, the crown transition profile 184 may include any number of transition points, and any number of radii of curvature. For example, the crown transition profile 184 may include one, two, three, four, five, six, seven, eight, nine, ten, or any other number of transition points. For further example, the crown transition profile 184 may include one, two, three, four, five, six, seven, eight, nine, ten, or any other number of radii of curvature.

Figure 6:
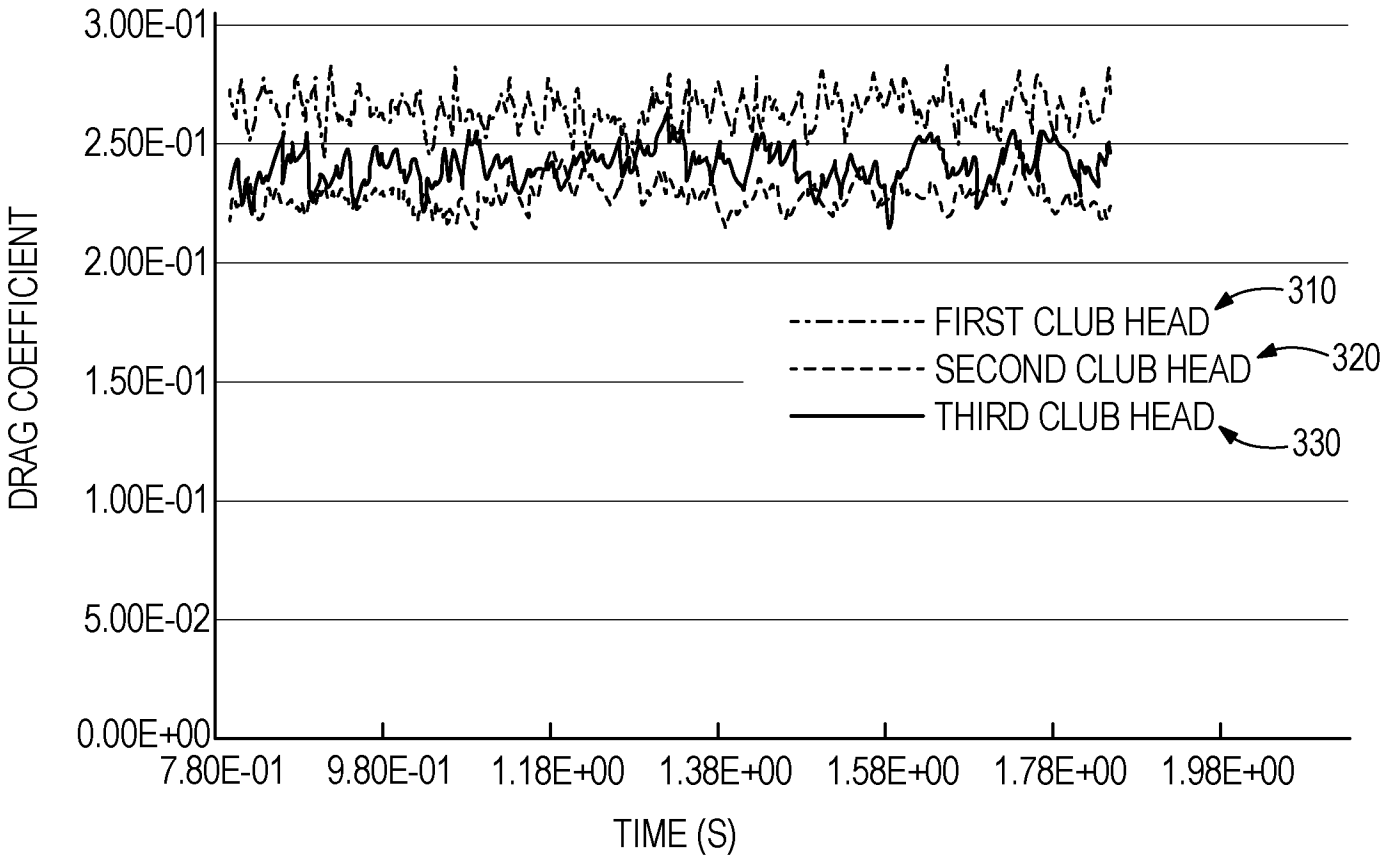
FIG. 6 illustrates data for the drag coefficient resulting from aerodynamic testing of exemplary golf club heads having varying crown transition profiles.
Figure 7:
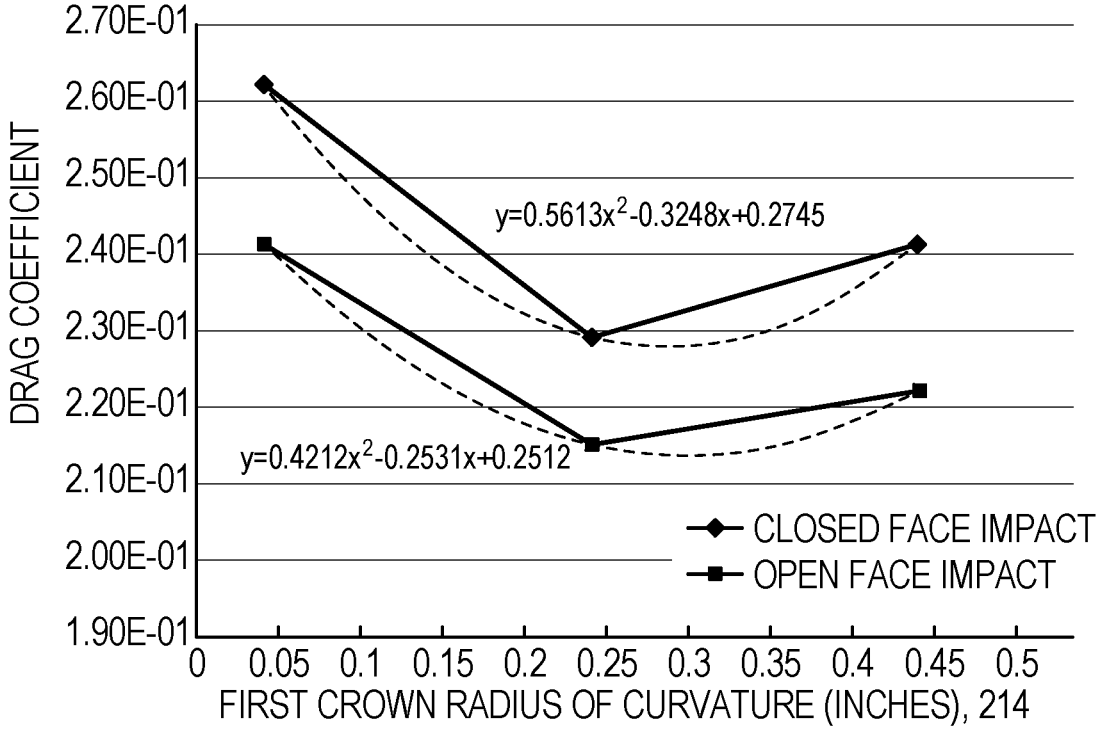
FIG. 7 illustrates a trend line of the data from the aerodynamic testing of the golf club heads in FIG. 5.

The aerodynamic drag reduction due to the first crown radius of curvature 214 was determined using wind tunnel testing for various exemplary club heads having varied first crown radii of curvature. Referring to FIGS. 6-7, a first club head 310 having a first crown radius of curvature of approximately 0.04 inches (0.10 cm), a second club head 320 having a first crown radius of curvature of approximately 0.24 inches (0.61 cm), and a third club head 330 having a first crown radius of curvature of approximately 0.44 inches (1.12 cm) were tested in a wind tunnel. The lowest aerodynamic drag, measured using the drag coefficient, was observed in the second club head 320 having the first crown radius of curvature of approximately 0.24 inches (0.61 cm) for both an open and closed face at impact. Further, in other embodiments, the lowest aerodynamic drag can be observed with a first crown radius of curvature between 0.20 inches (0.51 cm) and 0.28 inches (0.71 cm).

FIGS. 6 and 7 illustrates that increasing the first crown radius of curvature does not always result in reduced drag. For example, increasing the first crown radius of curvature may result in an increase or a decrease in drag. Similarly, decreasing the first crown radius of curvature does not always result in increased drag. For example, decreasing the first crown radius of curvature may result in an increase or a decrease in drag. In the illustrated example, when the first crown radius of curvature is increased from 0.04 inches (0.10 cm) to 0.24 inches (0.61 cm), the drag is reduced by a greater extent than when the first crown radius of curvature is increased from 0.04 inches (0.10 cm) to 0.44 inches (1.12 cm). Further, when the first crown radius of curvature is increased from 0.24 inches (0.61 cm) to 0.44 inches (1.12 cm), the drag on the club head 100 increases. Accordingly, an optimum first crown radius of curvature exists to reduce aerodynamic drag on the club head 100 for both an open and closed face at impact. FIG. 7 illustrates a curve fit to the data in FIG. 6 to determine the first crown radius of curvature of between approximately 0.20 inches (0.51 cm) and 0.28 inches (0.71 cm) results in the greatest drag reduction on the club head 100.

ii. Transition Points and Radii of Curvature of the Crown Transition Profile According to a Second Embodiment Moving ahead in the drawings, FIGS. 15-19 illustrate a second embodiment of a golf club head 700 including a body 704 and a strike face 708. The body 704 includes a front end 712, a back end 714 opposite the front end 712, a heel 716, a toe 720 opposite the heel 716, a crown 724 having a crown apex 728, and a sole 732 opposite the crown 724. The club head 700 can include a plurality of transition regions including a sole transition region, and a rear transition region as described in this disclosure. The club head 700 can comprise a sole transition region with a sole transition profile similar to the sole transition region 344 including the sole transition profile 384 as described in this disclosure. The club head 700 can comprise a rear transition region with a rear transition profile similar to the rear transition region 544 including the rear transition profile 584 as described in this disclosure. The club head 700 comprises a crown transition region 744 including a crown transition profile 784, described in more detail below.

Figure 15:
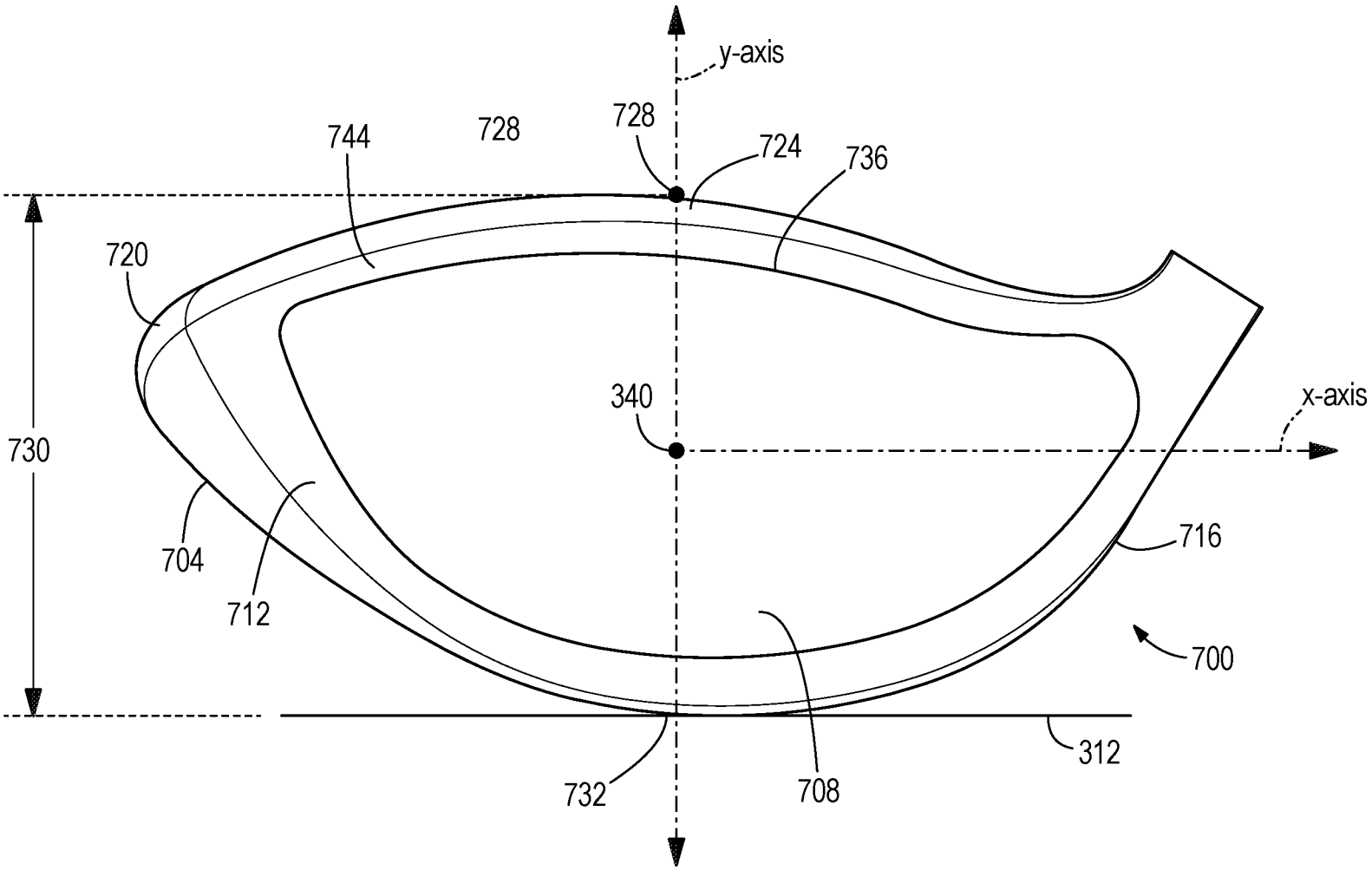
FIG. 15 is a front view of an exemplary golf club head according to a second embodiment.

Referring to FIG. 15, the strike face 708 includes a top edge 736, a bottom edge 738, and a geometric center 740. The top edge 736 extends along the front end 712 of the strike face 708 near the crown 724 where the curvature deviates from the bulge and roll of the strike face 708. The bottom edge 738 extends along the front end 712 of the strike face 708 near the sole 732 where the curvature deviates from the bulge and roll of the strike face 708. In some embodiments, the spline method can be used to determine where the curvature deviates from the bulge and roll of the strike face 708 at the top edge 736 or at the bottom edge 738, as described above in the definitions.

Figure 16:
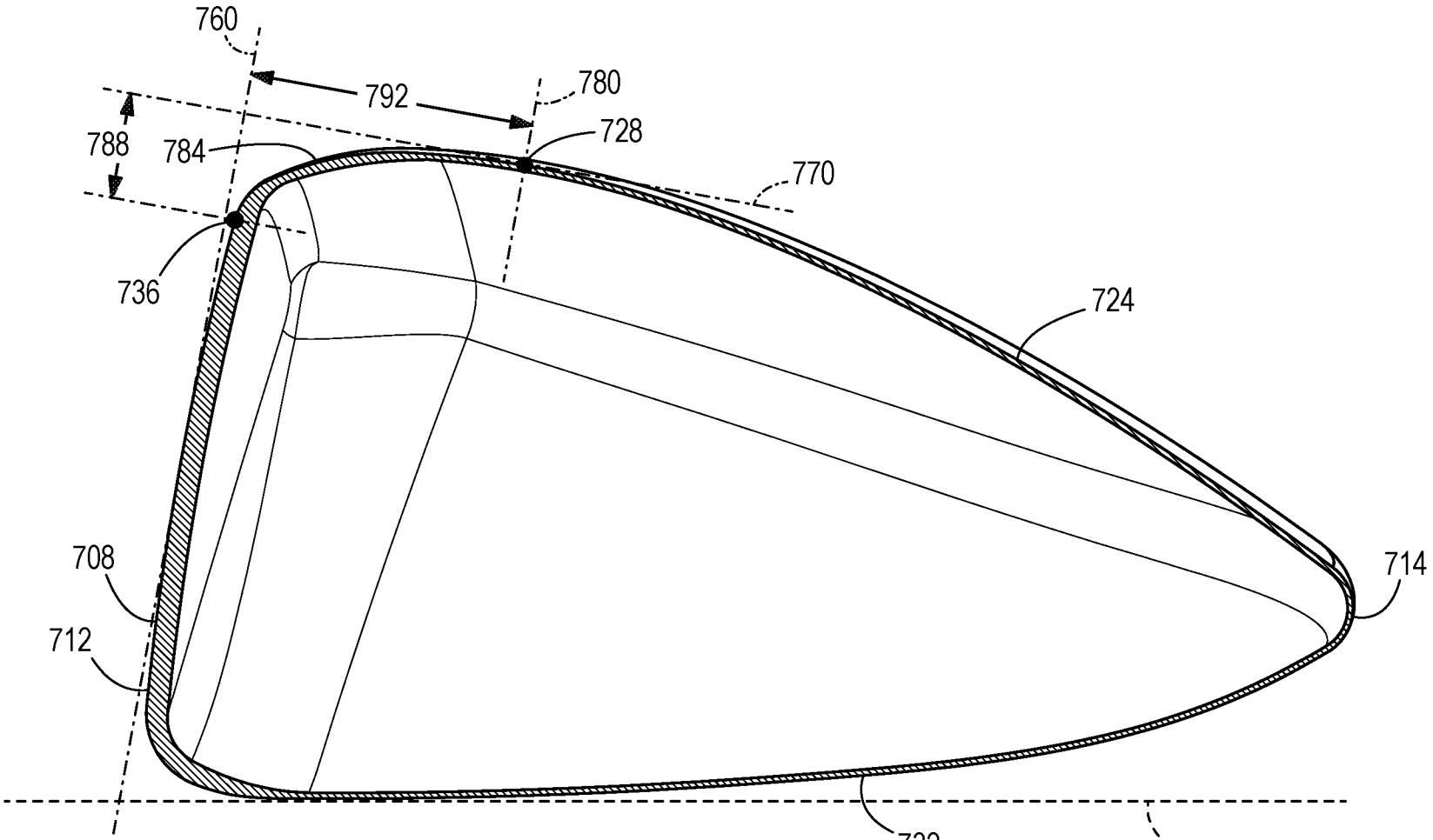
FIG. 16 is a side, cross sectional view of the golf club head in FIG. 15.

The club head 700 comprises a crown transition region 744 extending rearward from the top edge 736. Referring to FIG. 15, the crown transition region 744 extends between the strike face 708 and the crown 724 of the club head 700, from near the heel 716 to near the toe 720. Referring to FIG. 16, the golf club head 700 further includes a crown plane 770 and an apex plane 780. The crown plane 770 extends through the crown apex 728 of the crown 724 perpendicular to the loft plane 760. The apex plane 780 extends through the crown apex 728 of the crown 724 parallel to the loft plane 760.

Referring to FIGS. 15 and 16, the crown transition region 744 including a crown transition profile 784 extends from the top edge 736 on the front end 712 of the club head 700 to the apex plane 780, along the crown 724 of the club head 700. The geometric center 740 of the strike face 708 defines an origin of a coordinate system having an x-axis, a y-axis, and a z-axis. The coordinate system defined at the geometric center 740 can be similar to the coordinate system including the x-axis 314, y-axis 316, and z-axis 318 (FIG. 3) defined at the geometric center 140 as described above. The crown transition region 744 includes the crown transition profile 784 when viewed from a side cross sectional view taken along a plane defined by the y-axis and z-axis. In these embodiments, the side cross sectional view of the crown transition profile 784 can be taken at any point along the club head 100 from near the heel 716 to near the toe 720. Further, the club head 700 includes a loft plane 760 that extends tangent to the geometric center 740 of the strike face 708.

Figure 17:
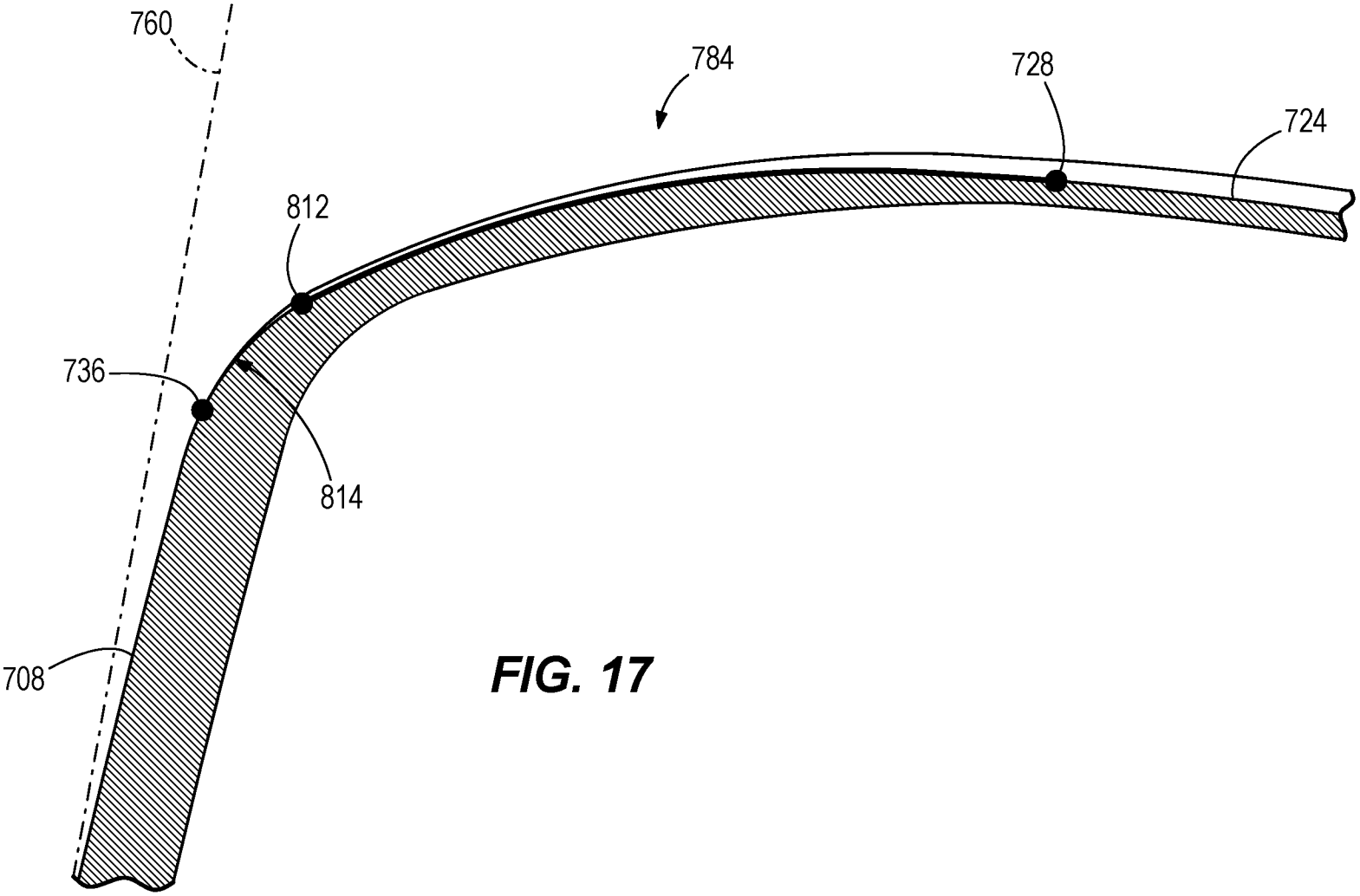
FIG. 17 is an enlarged side, cross sectional view of the crown transition profile of the golf club head in FIG. 15.
Figure 18:
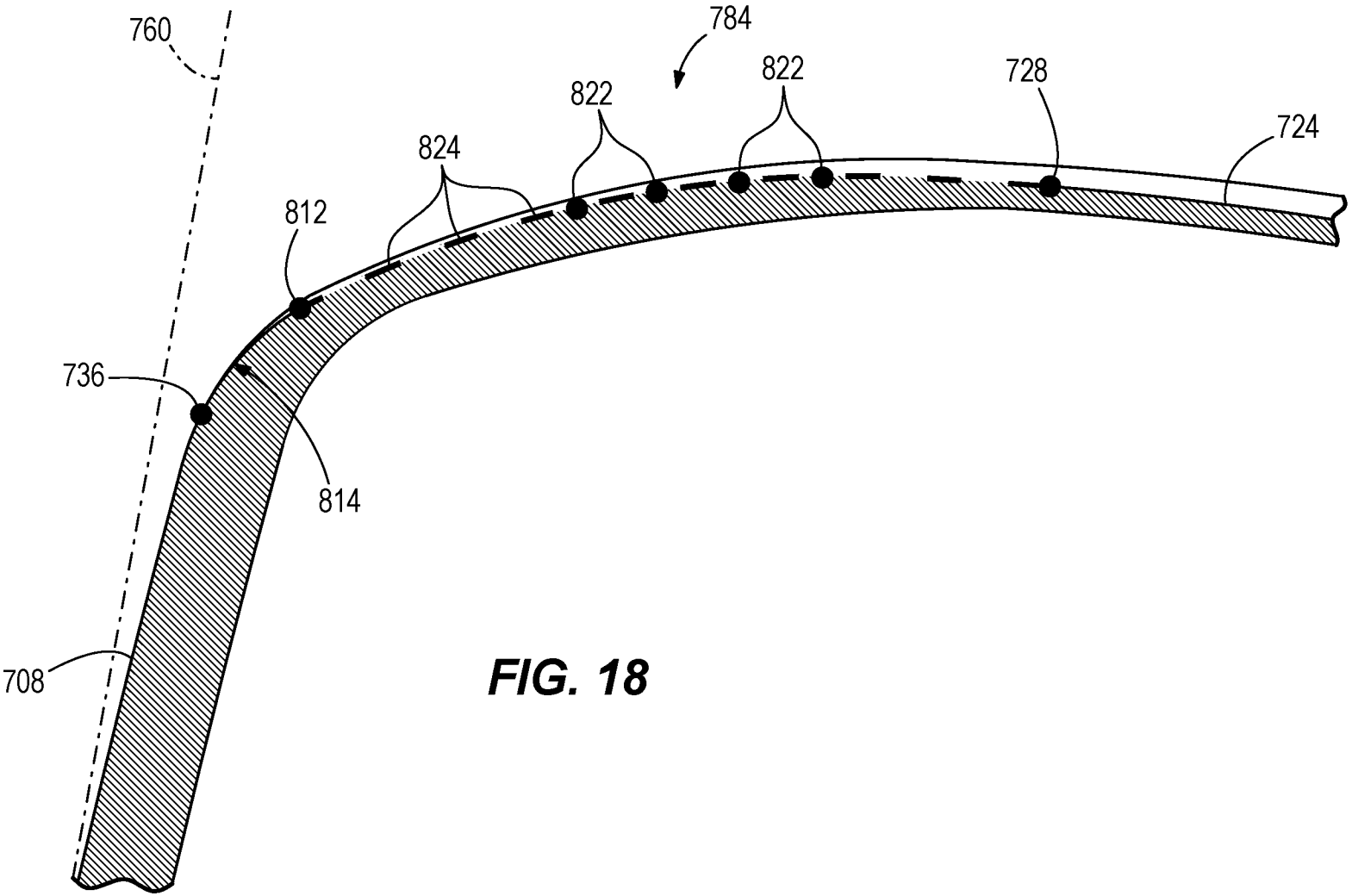
FIG. 18 is an enlarged side, cross sectional view of the crown transition profile of the golf club head in FIG. 15.
Figure 19:
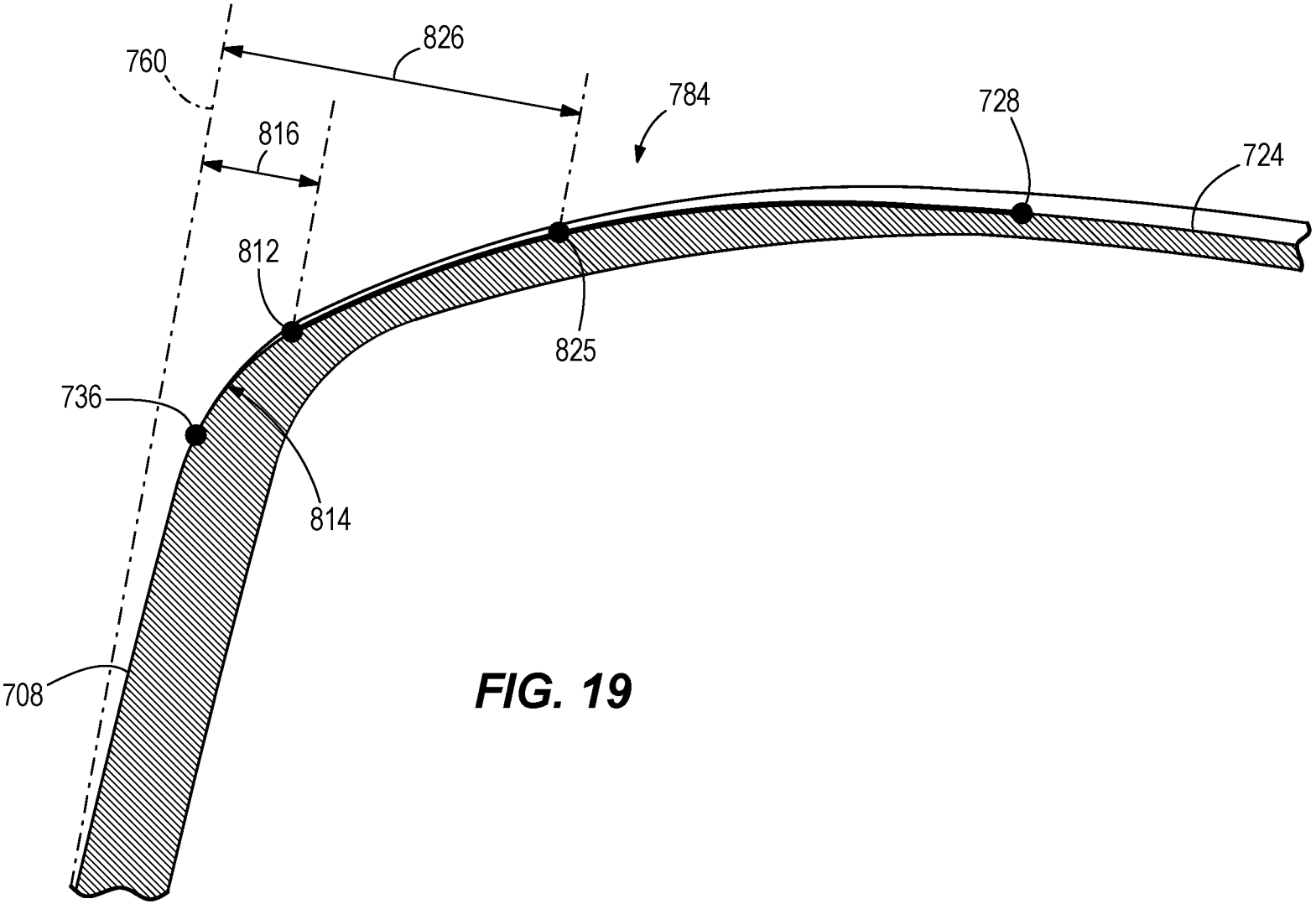
FIG. 19 is an enlarged side, cross sectional view of the crown transition profile of the golf club head in FIG. 15.

FIGS. 17-19 illustrates the crown transition profile 784. The crown transition profile 784 can be characterized by one or more radii of curvature and one or more transition points occurring between distinct radii of curvature. Specifically, referring to FIG. 18, the crown transition profile 784 can include a plurality of transition points 822 and a plurality of crown radii of curvature 824. The crown transition profile 784 can comprise any number of crown radii of curvature 824 and any number of transitions points 822. The transition points 822 occur at the location of any change in the crown radius of curvature 824 of the crown transition profile 784. In some embodiments, the crown radius of curvature 824 can comprise one, two, three, or more radii of curvature. In some embodiments, the radius of curvature 824 can vary continuously along the crown transition profile 784.

As illustrated in FIG. 19 and for simplicity of discussion, the crown transition profile 784 can be characterized by the radius and/or radii of curvature 824 occurring between the first crown transition point 812, a major crown transition point 825 (FIG. 19), and the crown apex 728. The club head 700 comprises a first crown radius of curvature 814 extending from the top edge 736 to the first crown transition point 812. The major crown transition point 825 is one of the transition points 822, as described above, and is used as a reference to describe the curvature in certain sections of the crown transition profile 784. The major crown transition point 825 can be located along the crown transition profile 784 at a major crown transition point offset distance 826 (described in further detail below). The club head 700 comprises one or more radii of curvature 824 between the first crown transition point 812 and the major crown transition point 825. In some embodiments, the crown transition profile 784 comprises a constant radius of curvature between the first crown transition point 812 and the major crown transition point 825. In other embodiments, the radius of curvature can vary between the first crown transition point 812 and the major crown transition point 825.

The club head 700 further comprises one or more radii of curvature 824 between the major crown transition point 825 and the crown apex 728. In some embodiments, the crown transition profile 784 comprises a constant radius of curvature between the major crown transition point 825 and the crown apex 728. In other embodiments, the radius of curvature can vary between the major crown transition point 825 and the crown apex 728. The first crown radius of curvature 814 extending from the top edge 736 to the first crown transition point 812, the curvature(s) 824 between the first crown transition point 812 and the major crown transition point 825, and the curvature(s) 824 between the major crown transition point 825 and the crown apex 728 collectively form the entire crown transition profile 184.

The first crown radius of curvature 814 between the top edge 736 and the first crown transition point 812 can be approximately 0.24 inches (0.61 cm). In other embodiments, the first crown radius of curvature 814 can range from approximately 0.18 to 0.30 inches (0.46 to 0.76 cm). Further, in other embodiments, the first crown radius of curvature 814 can be less than 0.40 inches (1.02 cm), less than 0.375 inches (0.95 cm), less than 0.35 inches (0.89 cm), less than 0.325 inches (0.83 cm), or less than 0.30 inches 0.76 cm). For example, the first crown radius of curvature 814 may be approximately 0.18 inches (0.46 cm), 0.20 inches (0.51 cm), 0.22 inches (0.66 cm), 0.24 inches (0.61 cm), 0.26 inches (0.66 cm), 0.28 inches (0.71 cm), or 0.30 inches (0.76 cm).

The crown radii of curvature 824 of the crown transition profile 784 increase in a direction from the top edge 736 to the crown apex 728 (i.e. the crown radii of curvature 824 can be smaller near the top edge 736, and become larger near the crown apex 728). The first crown radius of curvature 814 between the top edge 736 and the first crown transition point 812 can be the smallest radius of curvature of the crown transition profile 784. The curvature(s) 824 between the first crown transition point 812 and the major crown transition point 825 can be greater than the first crown radius of curvature 814, but less than the curvature(s) 824 between the major crown transition point 825 and the crown apex 728. The curvature(s) 824 between the major crown transition point 825 and the crown apex 728 are greater than the curvature(s) 824 between the first crown transition point 812 and the major crown transition point 825. The crown radius of curvature at the crown apex 728 can be the largest radius of curvature of the crown transition profile 784.

The first crown radius of curvature 814, a crown radius of curvature measured at the major crown transition point 825, and a crown radius of curvature measured at the crown apex 728 can be different. In other words, the first crown radius of curvature 814 can be less than the crown radius of curvature measured at the major crown transition point 825. The first crown radius of curvature 814 can be less than the crown radius of curvature measured at the crown apex 728. Further, the crown radius of curvature measured at the major crown transition point 825 can be less than the crown radius of curvature measured at the crown apex 728. Further, the crown radius of curvature measured at the major crown transition point 825 can be greater than the first crown radius of curvature 814. Further still, the crown radius of curvature measured at the crown apex 728 can be greater than the first crown radius of curvature 814 and the crown radius of curvature measured at the major crown transition point 825.

The major crown transition point 825 is one of the transition points 822, as described above, and is used as a reference to describe the curvature in certain sections of the crown transition profile 784. The major crown transition point 825 can be located along the crown transition profile 784 at a major crown transition point offset distance 826 (described in further detail below). In many embodiments, the major crown transition point 825 represents a point on the crown transition profile 784 where the crown transition profile 784 transitions from a smaller crown radius of curvature 824 (i.e. sharper radii) to a larger crown radius of curvature 824 (i.e. flatter radii). The curvature of the crown transition profile 784, moving in a direction extending rearward the loft plane 760 or the top edge 736, ramps up quickly from the top edge 736 of the strike face 708 to the major crown transition point 825, and then flattens out moving towards the apex 738. The shaping of the crown transition profile 784 (i.e. quick ramp up to the major crown transition point 825, then flatter near the apex 738) creates a larger crown transition region 744, which allows air to move away faster from strike face 708. Moving air away faster from the strike face 708 reduces aerodynamic drag on the crown 724.

To achieve the desirable crown transition profile 784 shape described above, the curvature 824 of the crown transition profile 784 between the first crown transition point 812 and the crown apex 728 can be less than 3.0 inches. In other embodiments, the curvature 824 of the crown transition profile 784 between the first crown transition point 812 and the crown apex 728 can be less than 3.0, 2.9, 2.9, 2.8, 2.7, 2.6, or 2.5 inches. In other embodiments, the curvature 824 of the crown transition profile 784 between the first crown transition point 812 and the crown apex 128 can range between 0.30 to 3.0 inches. The curvature 824 of the crown transition profile 784 between the first crown transition point 812 and the crown apex 728 can range from 0.18 to 3.0 inches, 0.20 to 3.0 inches, or 0.24 to 3.0 inches. In embodiments comprising multiple radii of curvature 824 between the first crown transition point 812 and the crown apex 728, each of said multiple radii of curvature 824 can be less than 3.0 inches.

The curvature 824 of the crown transition profile 784 between the first crown transition point 812 and the major crown transition point 825 can be less than 2 inches. In other embodiments, the curvature 824 of the crown transition profile 784 between the first crown transition point 812 and the major crown transition point 825 can be less than 1.9, 1.8, 1.7, 1.6, 1.5, 1.4, 1.3, 1.2, 1.1, or 1.0 inches. In other embodiments, the curvature 824 of the crown transition profile 784 between the first crown transition point 812 and the major crown transition point 825 can range from 0.18 to 2 inches, 0.2 to 2 inches, 0.24 to 2 inches, or 0.30 to 2 inches. In embodiments comprising multiple radii of curvature 824 between the first crown transition point 812 and the major crown transition point 825, each of said multiple radii of curvature 824 can be less than 2.0 inches.

The crown radii of curvature 824 of the crown transition profile 784 between the major crown transition point 825 and the crown apex 728 can range between 2 to 3.0 inches. In other embodiments, the crown radii of curvature 824 of the crown transition profile 784 between the major crown transition point 825 and the crown apex 728 can range between 2.1 to 3.0 inches, 2.2 to 3.0 inches, 2.3 to 3.0 inches, 2.4 to 3.0 inches, or 2.5 to 3.0 inches. Further, the crown radius of curvature measured at the crown apex 728 can range from 2.5 to 3.0 inches. For example, the crown radius of curvature measured at the crown apex 728 can be 2.5, 2.6, 2.7, 2.8, 2.9, or 3.0 inches. In embodiments comprising multiple radii of curvature 824 between the major crown transition point 825 and the crown apex 728, each of said multiple radii of curvature 824 can be between 2.0 and 3.0 inches.

Referring to FIG. 19, the first crown transition point 812 is offset from the loft plane 760 by a first offset distance 816. The major crown transition point 825 is offset from the loft plane 760 by a major point offset distance 826. The major point offset distance 826 is greater than the first offset distance 816. The major point offset distance 826 is less than the crown apex 128 is offset from the loft plane 760 or a crown apex distance 792 (FIG. 16).

Referring to FIG. 19, the first offset distance 816 can range from approximately 0.08 to 0.20 inch. In other embodiments, the first offset distance 816 can range from 0.08 inch to 0.18 inch, 0.09 to 0.19 inch, or 0.1 to 0.2 inch.

For example, the first offset distance 816 can be 0.08, 0.09, 0.10, 0.11, 0.12, 0.13, 0.14, 0.15, 0.16, 0.17, 0.18, 0.19, or 0.20 inch.

The major point offset distance 826 can be less than 0.7 inch, less than 0.65 inch, less than 0.6 inch, less than 0.55 inch, less than 0.5 inch, less than 0.45 inch, less than 0.40 inch, less than 0.35 inch, less than 0.3 inches, or less than 0.25 inch. In other embodiments, the major point offset distance 826 can range from 0.2 to 0.7 inch. In other embodiments, the major point offset distance 826 can range from 0.2 to 0.5 inch, 0.4 to 0.7 inch, or 0.5 to 0.7 inch. In other embodiments still, the major point offset distance 826 can range from 0.2 to 0.4 inch, or 0.4 to 0.7 inch. For example, the major point offset distance 826 can be 0.2, 0.25, 0.3, 0.35, 0.4, 0.45, 0.5, 0.55, 0.6, 0.65, or 0.7.

For example, the curvature 824 between the first crown transition point 812 and the major crown transition point 825 can range between 0.3 inch to 2 inches when the major point offset distance 826 is less than 0.5 inch. For example, the curvature 824 between the first crown transition point 812 and the major crown transition point 825 can range between 0.24 inch to 2 inches when the major point offset distance 826 is less than 0.5 inch. For example, the curvature 824 between the first crown transition point 812 and the major crown transition point 825 can range between 0.3 inch to 1.5 inches when the major point offset distance 826 is less than 0.4 inch. For example, the curvature 824 between the first crown transition point 812 and the major crown transition point 825 can range between 0.24 inch to 1.5 inches when the major point offset distance 826 is less than 0.4 inch. For example, the curvature 824 between the first crown transition point 812 and the major crown transition point 825 can range between 0.3 inch to 1.0 inches when the major point offset distance 826 is less than 0.3 inch. For further example, the curvature 824 between the first crown transition point 812 and the major crown transition point 825 can range between 0.24 inch to 1.0 inches when the major point offset distance 826 is less than 0.3 inch.

The curvature 824 of the crown transition profile 784 between the top edge 736 and the major crown transition point 825 can be smaller or sharper compared to club heads that generally disclose a radius of curvature less than 3 inches between the front end of the club head and the crown apex. In one example, wherein the major point offset distance 826 can be less than 0.5 inch, the curvature 824 of the crown transition profile 784 between the top edge 736 and the major crown transition point 825 can be less than 2.0 inches. In another example, wherein the major point offset distance 826 can be less than 0.4 inch, the curvature 824 of the crown transition profile 784 between the top edge 736 and the major crown transition point 825 can be less 1.5 inches. The curvature 824 of the crown transition profile 784 between the top edge 736 and the major crown transition point 825 comprise smaller radii to greatly improve the aerodynamic performance of the club head 700 over club heads that generally disclose a radius of curvature less than 3 inches between the front end of the club head and the crown apex. Club heads that generally disclose a radius of curvature less than 3 inches between the front end of the club head and the crown apex fail to recognize small curvatures less than 2.0 inch between the top edge 736 and the major crown transition point 825. In contrast, the shaping of the crown transition profile 784 (i.e. quick ramp up to the major crown transition point 825, then flatter near the apex 738) creates a larger crown transition region 744, which allows air to move away faster from strike face 708. Moving air away faster from the strike face 708 reduces aerodynamic drag on the crown 724.

In another example, wherein the major point offset distance 826 can be less than 0.3 inch, the curvature 824 of the crown transition profile 784 between the top edge 736 and the major crown transition point 825 can be less than 1.0 inch. The curvature 824 of the crown transition profile 784 between the top edge 736 and the major crown transition point 825 comprises smaller radii to greatly improve the aerodynamic performance of the club head 700 over club heads that generally disclose a radius of curvature less than 3 inches between the front end of the club head and the crown apex. Club heads that generally disclose a radius of curvature less than 3 inches between the front end of the club head and the crown apex fail to recognize small curvatures less than 1.0 inch between the top edge 736 and the major crown transition point 825. In contrast, the shaping of the crown transition profile 784 (i.e. quick ramp up to the major crown transition point 825, then flatter near the apex 738) creates a larger crown transition region 744, which allows air to move away faster from strike face 708. Moving air away faster from the strike face 708 reduces aerodynamic drag on the crown 724.

Referring to FIGS. 15 and 16, the location of the crown apex 728 on the crown 724 is important for aerodynamic drag reduction. The crown apex 728 can be located with respect to the loft plane 760 and the ground plane 312. The crown apex 728 of the club head 700 is offset from the loft plane 760 by an apex distance 792 (FIG. 16) measured in a direction perpendicular to the loft plane 760. In the illustrated embodiment, the apex distance 792 is approximately 1.0 inch (2.54 cm). In other embodiments, the apex distance 792 can range from approximately 0.5 inches to 1.2 inches. In other embodiments, the apex distance 792 can range from approximately 0.7 inches to 1.2 inches, or 0.9 inch to 1.2 inches. In other embodiments still, the apex distance 792 can range from approximately 0.8 inches (2.03 cm) to 1.4 inches (3.56 cm), from approximately 0.9 inches (2.29 cm) to approximately 1.3 inches (3.3 cm), or from approximately 1.0 inch (2.54 cm) to 1.2 inches (3.05 cm). For example, the apex distance 792 can be approximately 0.5 inch, 0.55 inch, 0.6 inch, 0.65 inch, 0.7 inch, 0.75 inch, 0.8 inch, 0.85 inch, 0.9 inches (2.29 cm), 1.0 inches (2.54 cm), 1.1 inches (2.79 cm), 1.2 inches (3.05 cm), 1.3 inches (3.30 cm), or 1.4 inches (3.56 cm).

Referring to FIG. 15, the club head 700 comprises an apex height 730 measured between the crown apex 728 and the ground plane 312. The apex height 730 is measured perpendicular to the ground plane 312 and parallel to the y-axis 316. The apex height 730 can range from 2 to 3 inches. In other embodiments still, the apex height 730 can range from 2 to 2.5 inches, or 2.5 to 3 inches. For example, the apex height 730 can be 2, 2.1, 2.2, 2.3, 2.4, 2.45, 2.5, 2.6, 2.7, 2.8, 2.9, or 3 inches.

iii. Angles of the Crown Transition Profile

Figure 5:
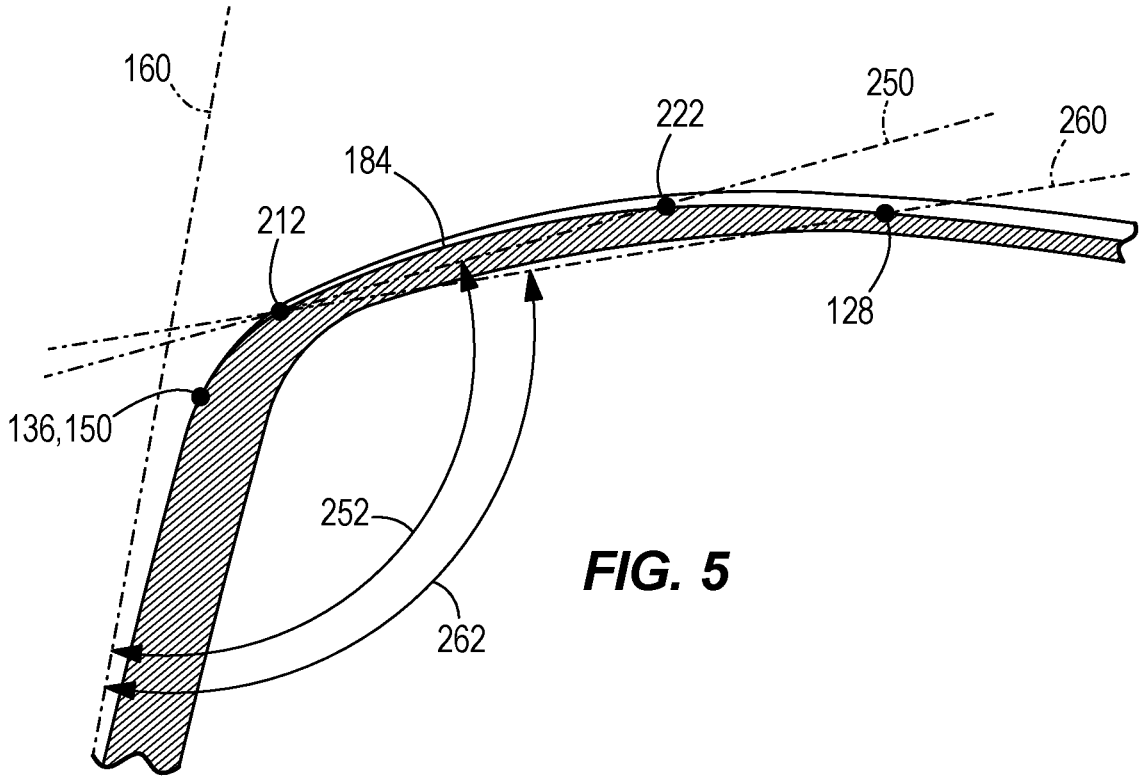
FIG. 5 is another enlarged side cross sectional view of the crown transition profile of the golf club head in FIG. 1.

Backtracking through the figures and referring to FIG. 5, the crown transition profile 184 can be further characterized by the position of the first and the second crown transition points 212, 222 in relation to the apex 128 and the loft plane 160. When viewed from a side cross sectional view taken along a plane defined by the y-axis 316 and z-axis 318, the crown transition profile 184 includes a first axis 250, a second axis 260, a first angle 252, and a second angle 262. The first axis 250 extends through the first crown transition point 212 and the second crown transition point 222, and forms the first angle 252 with the loft plane 160. The second axis 260 extends through the first crown transition point 212 and the apex 128, and forms the second angle 262 with the loft plane 160. In the illustrated embodiment, the first angle 252 of the crown transition profile 184 ranges from approximately 111.0-114.5 degrees and the second angle 262 of the crown transition profile 184 ranges from 103.5-105 degrees. In other embodiments, the first angle 252 of the crown transition profile 184 may range from approximately 100-125 degrees, and the second angle 262 of the crown transition profile 184 may range from 90-120 degrees. In other embodiments, the second angle 262 of the crown transition profile 184 may be any value greater than 98 degrees, greater than 100 degrees, or greater than 102 degrees.

iv. Aerodynamic Improvements Resulting from the Crown Transition Profile

The golf club head 100 having the crown transition profile 184, as described herein, was compared to a control golf club head during wind tunnel testing. The control golf club head had a crown transition profile with a first ratio of approximately 3.50-3.52, a length of approximately 1.12-1.19 inches (2.84-3.02 cm), a height of approximately 0.32-0.34 inches (0.81-0.86 cm). Aerodynamic drag was determined for both golf club heads using the same testing parameters (e.g. wind speed, club head position). The club head 100 having the crown transition profile 184, as described herein, experienced 34.0-39.4% less drag than the control golf club head, with an average drag reduction of approximately 35.9% for an average club head speed at impact. Reduced aerodynamic drag of the club head 100 resulting from the crown transition profile 184 results in increased swing speeds and ball distance.

v. Apex Distance and Height

Referring back to FIGS. 2 and 3, the apex 128 of the club head 100 is offset from the loft plane 160 by an apex distance measured in a direction perpendicular to the loft plane 160. In the illustrated embodiment, the apex distance is approximately 1.0 inch (2.54 cm). In other embodiments, the apex distance can range from approximately 0.8 inches (2.03 cm) to 1.4 inches (3.56 cm), from approximately 0.9 inches (2.29 cm) to approximately 1.3 inches 3.3 cm), or from approximately 1.0 inch (2.54 cm) to 1.2 inches (3.05 cm). For example, the apex distance can be approximately 0.9 inches (2.29 cm), 1.0 inches (2.54 cm), 1.1 inches (2.79 cm), 1.2 inches (3.05 cm), 1.3 inches (3.30 cm), or 1.4 inches (3.56 cm).

Figure 8:
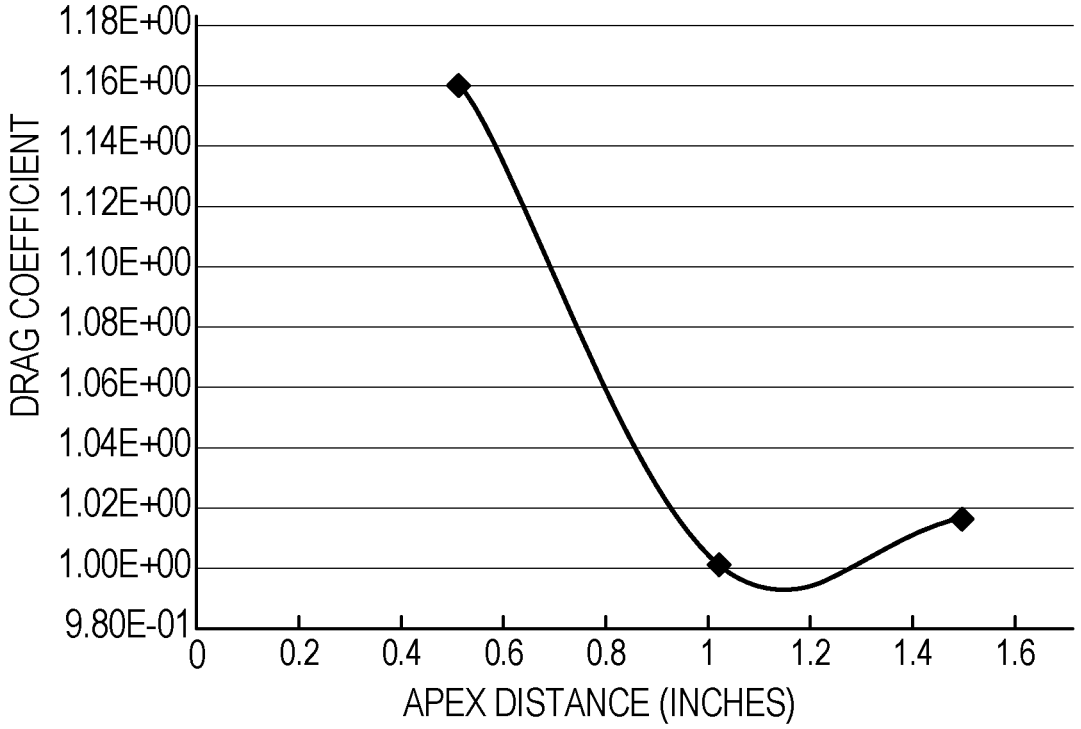
FIG. 8 illustrates aerodynamic data for the drag coefficient resulting from aerodynamic testing of exemplary golf club heads having varying crown transition profile lengths.

In many embodiments, aerodynamic drag reduction can result from varying the apex distance. The aerodynamic drag reduction due to the apex distance was determined using wind tunnel testing for various exemplary club heads having varied apex distances. Referring to FIG. 8, a first club head having an apex distance of approximately 0.05 inches (1.27 cm), a second club head having an apex distance of approximately 1.0 inches (2.54 cm), and a third club head having an apex distance of approximately 1.5 inches (3.81 cm) were tested in a wind tunnel. The lowest aerodynamic drag, measured using the drag coefficient, was observed in the second club head having the apex distance of approximately 1.0 inches (2.54 cm).

FIG. 8 illustrates that increasing the apex distance does not always result in reduced drag. For example, increasing the apex distance may result in an increase or a decrease in drag. Similarly, decreasing the apex distance does not always result in increased drag. For example, decreasing the apex distance may result in an increase or a decrease in drag. In the illustrated example, when the apex distance is increased from 0.5 inches (1.27 cm) to 1.0 inches (2.54 cm), the drag is reduced by a greater extent than when the apex distance is increased from 0.5 inches (2.17 cm) to 1.5 inches (3.81 cm). Further, when the apex distance is increased from 1.0 inches (2.54 cm) to 1.5 inches (3.81 cm), the drag on the club head 100 increases. Accordingly, an optimum apex distance exists to reduce aerodynamic drag on the club head 100.

Referring to FIG. 1, the apex 128 of the club head 100 comprises an apex height 130 measured above the ground plane 312. The apex height 130 is measured perpendicular to the ground plane 312 and parallel to the y-axis 316. The apex height 130 can range from 2-3 inches. In other embodiments still, the apex height 130 can range from 2-2.5 inches, or 2.5-3 inches. For example, the apex height 130 can be 2, 2.1, 2.2, 2.3, 2.4, 2.45, 2.5, 2.6, 2.7, 2.8, 2.9, or 3 inches.

vi. Heel to Toe Radius of Curvature

Referring back to FIG. 1, in addition to the crown transition profile 184, the club head 100 further includes a heel to toe radius of curvature positioned on the front end 112 extending from near the heel 116 to near the toe 120 when viewed from a front view. In many embodiments, increasing the heel to toe radius of curvature can further reduce the aerodynamic drag of the club head 100 during a swing.

The heel to toe radius of curvature can be determined using a three point method. The three point method includes positioning three points along the top edge 136 on the front end 112 of the club head 100. The three points include a first point 272 positioned along the top edge 136 in line with the geometric center 140 of the strike face 108 in the direction of the x-axis 316, a second point 274 positioned along the top edge 136 offset from the geometric center 140 of the strike face 108 in the direction of the x-axis 316 by 1.0 inch (2.54 cm) toward the heel 116 of the club head 100, and a third point 276 positioned along the top edge 136 offset from the geometric center 140 of the strike face 108 in the direction of the x-axis 316 by 1.0 inch (2.54 cm) toward the toe 120 of the club head 100. The radius of a circle formed to intersect the first, the second, and the third points defines the heel to toe radius of curvature of the front end 112 of the club head 1000.

In the illustrated embodiment, the heel to toe radius of curvature extends along the entire top edge 136 of the strike face 108 from near the heel 116 to near the toe 120. In other embodiments, the heel to toe radius of curvature can extend along a portion of the top edge 136 of the strike face 108.

Increasing the heel to toe radius of curvature can reduce aerodynamic drag on a golf club head during a swing. In the illustrated embodiment, the heel to toe radius of curvature is approximately 6.325 inches (16.07 cm) to reduce aerodynamic drag compared to a similar club head having a lower heel to toe radius of curvature. In other embodiments, aerodynamic drag on the club head 100 can be reduced with a heel to toe radius of curvature greater than approximately 4.9 inches (12.4 cm), greater than approximately 5.2 inches (13.2 cm), greater than approximately 5.5 inches (14.0 cm), greater than approximately 5.8 inches (14.7 cm), greater than approximately 6.0 inches (15.2 cm), greater than approximately 6.1 inches (15.5 cm), greater than approximately 6.2 inches (15.7 cm), greater than approximately 6.3 inches (16.0 cm), greater than approximately 6.4 inches (16.3 cm), greater than approximately 6.5 inches (16.5 cm), greater than approximately 6.6 inches (16.8 cm), greater than approximately 6.7 inches (17.0 cm), greater than approximately 6.8 inches (17.3 cm), greater than 6.9 inches (17.5 cm), or greater than approximately 7.0 inches (17.8 cm). Further, in other embodiments, aerodynamic drag on the club head 100 can be reduced with a heel to toe radius of curvature between approximately 5.0-6.5 inches (12.7-16.5 cm), between approximately 5.25-6.75 inches (13.3-17.1 cm), between approximately 5.5-7.0 inches (14.0-17.8 cm), between approximately 5.75-7.25 inches (14.6-18.4 cm), between 6.0-7.5 inches (15.2-19.1 cm), or between 6.25-7.75 inches (15.9-19.7 cm).

The increased heel to toe radius of curvature results in a flattened shape of the crown transition region 144 in a heel to toe direction when viewed from a front view, compared to a similar club head having a lower heel to toe radius of curvature. The flattened shape maintains laminar flow and reduces turbulent flow over the heel and toe regions of the crown to reduce the aerodynamic drag on the club head 100.

II. Sole Transition Region

Referring to FIG. 1, the sole transition region 344 extends between the strike face 108 and the sole 132 of the club head 100, from near the heel 116 to near the toe 120. The sole transition region 344 of the golf club head 100 is further described herein in relation to various reference planes and axes, as described below.

Further referring to FIG. 1, the golf club head 100 includes a curved axis 350 that extends along the front end 112 of the body 104 from the heel 116 to the toe 120. In the illustrated embodiment, the curved axis 350 extends along the bottom edge 138 of the strike face 108. In other embodiments, the curved axis 350 may be offset from the bottom edge 138 of the strike face 108 toward the sole 132. The curved axis 350 may be offset from the bottom edge 138 of the strike face 108 by a constant distance moving from the heel 116 to the toe 120, or the curved axis 350 may be offset from the top edge 138 of the strike face 108 by a varying distance moving from the heel 116 to the toe 120. For example, the curved axis 350 may be offset from the bottom edge 138 of the strike face 108 by a greater or lesser distance near the center, the heel 116, the toe 120, or any combination of the described positions on the club head 100.

Referring to FIG. 2, the golf club head 100 further includes a sole plane 380. The sole plane 380 extends through a lowest point of the sole 328 parallel to the loft plane 160. The intersection of the sole plane 380 with the sole 132 of the club head 100 further defines a curved sole axis 382.

Figure 9:
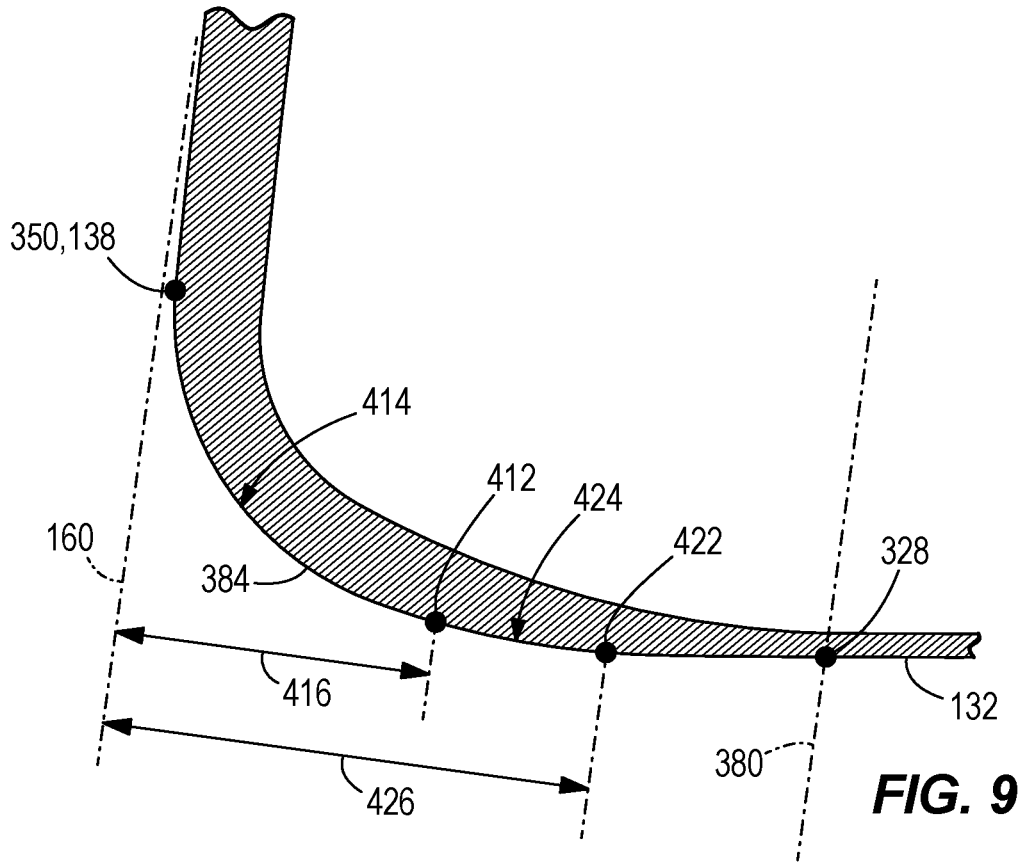
FIG. 9 is an enlarged side cross sectional view of the sole transition profile of the golf club head in FIG. 1.
Figure 10:
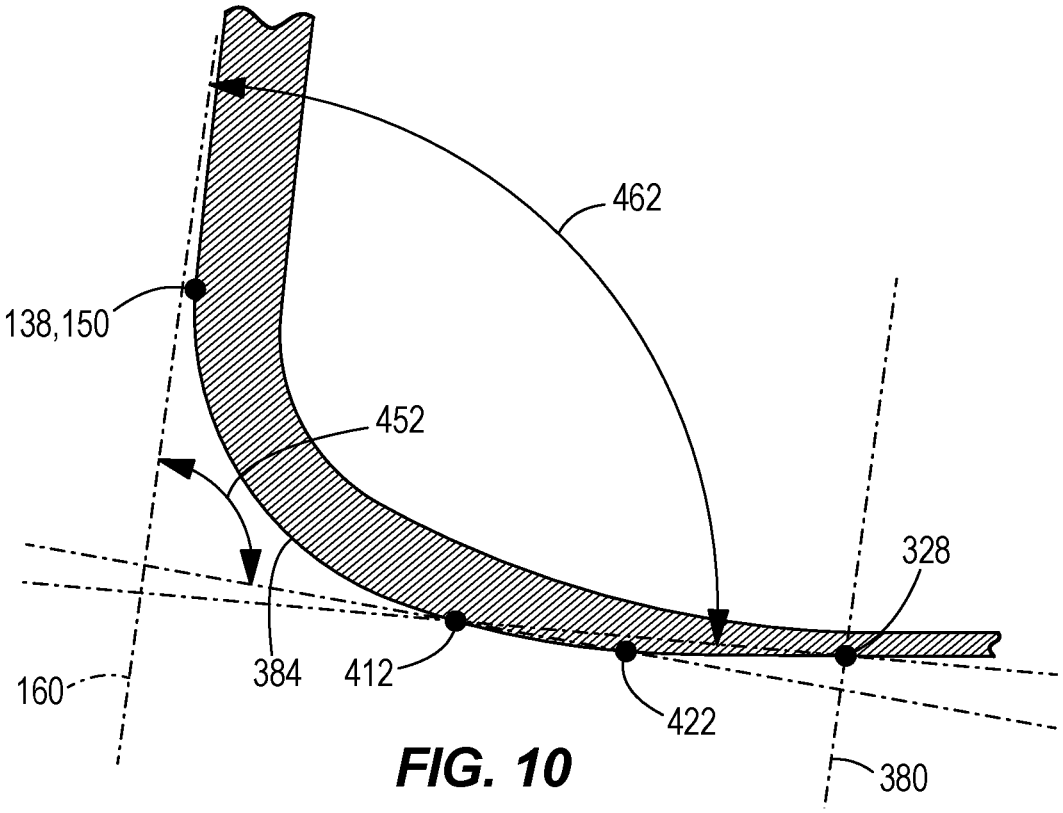
FIG. 10 is another enlarged side cross sectional view of the sole transition profile of the golf club head in FIG. 1.

Referring to FIGS. 2, 9, and 10, the sole transition region 344 extends from the bottom edge 138 on the front end 112 of the club head 100 to the sole plane 380, along the sole 132 of the club head 100. The sole transition region 344 includes a sole transition profile 384 when viewed from a side cross sectional view taken along a plane defined by the y-axis 316 (FIG. 2) and z-axis 318 (FIG. 3). In these embodiments, the side cross sectional view can be taken at any point along the club head 100 from near the heel 116 to near the toe 120.

i. Height and Length of the Sole Transition Profile

Referring to FIG. 2, the sole transition profile 384 includes a height 388 and a length 392. The height 388 of the sole transition profile 384 is the distance from the bottom edge 138 to the curved sole axis in a direction parallel to the loft plane 160. The length 392 of the sole transition profile 384 is the perpendicular distance from the loft plane 160 to the sole plane 380.

Referring to FIG. 2, in the illustrated embodiment, the length 392 of the sole transition profile 384 ranges from approximately 0.55-0.65 inches (1.40-1.65 cm). In other embodiments, the length 392 of the sole transition profile 384 may range from approximately 0.10-1.25 inches (0.25-3.18 cm) or from approximately 0.30-0.90 inches (0.76-2.29 cm). For example, the length 392 of the sole transition profile 384 may be approximately 0.10 inches (0.25 cm), 0.20 inches (0.51 cm), 0.30 inches (0.76 cm), 0.40 inches (1.02 cm), 0.45 inches (1.14 cm), 0.50 inches (1.27 cm), 0.55 inches (1.40 cm), 0.60 inches (1.52 cm), 0.65 inches (1.65 cm), 0.70 inches (1.48 cm), 0.75 inches (1.91 cm), 0.80 inches (2.03 cm), 0.90 inches (2.29 cm), 1.0 inches (2.54 cm), 1.1 inches (2.79 cm), or 1.2 inches 3.05 cm).

Further referring to FIG. 2, in the illustrated embodiment, the height 388 of the sole transition profile 384 ranges from approximately 0.23-0.31 inches (0.58-0.79 cm). In other embodiments, the height 388 of the sole transition profile 384 may range from approximately 0.05-0.4 inches (0.13-1.02 cm). For example, the height 388 of the sole transition profile 384 may be approximately 0.10 inches (0.25 cm), 0.15 inches (0.38 cm), 0.20 inches (0.51 cm), 0.25 inches (0.064 cm), 0.30 inches (0.76 cm), 0.35 inches (0.90 cm), or 0.40 inches (1.02 cm).

The club head 100 further includes a first ratio of the length 392 to the height 388 of the sole transition profile 384. In the illustrated embodiment, the first ratio of the sole transition profile 384 ranges from approximately 2.0-2.5. In other embodiments, the first ratio of the sole transition profile 384 may range from approximately 1.3-3.5. Further, in other embodiments, the first ratio of the sole transition profile 384 may be any value less than approximately 5.0, less than approximately 4.5, less than approximately 3.5, less than approximately 3.0, or less than approximately 2.5. For example, the first ratio of the sole transition profile 384 may be approximately 1.5, 2.0, 2.5, 3.0, 3.5, 4.0, 4.5, or 5.0.

ii. Transition Points and Radii of Curvature of the Sole Transition Profile

Referring to FIG. 9, the sole transition profile 384 further includes more than one radius of curvature and more than one transition point. The transition points indicate a change in the radius of curvature of the sole transition profile 384. In the illustrated embodiment, the sole transition profile 384 includes a first sole transition point 412, a second sole transition point 422, a first sole radius of curvature 414, and a second sole radius of curvature 424. The first sole transition point 412 is offset from the loft plane 160 by a first offset distance 416. The second sole transition point 222 is offset from the loft plane 160 by a second offset distance 426. The second offset distance 426 is greater than the first offset distance 416. The first sole radius of curvature 414 extends from the bottom edge 138 to the first sole transition point 412. The second sole radius of curvature 424 extends from the first sole transition point 412 to the second sole transition point 422.

Referring to FIG. 9, in the illustrated embodiment, the first offset distance 416 and the second offset distance 426 are substantially constant from the heel 116 to the toe 120 of the club head 100. In other embodiments, the first offset distance 416 may vary from the heel 116 to the toe 120 of the club head 100. For example, the first offset distance 416 may be greater toward the heel 116 of the club head 100, toward the toe 116 of the club head 100, in the center of the club head 100, or in any combination of the above described positions. The first offset distance 416 may vary from the heel 116 to the toe 120 according to any profile, such as, for example, linear, parabolic, quadratic, exponential, or any other profile.

Further, in other embodiments, the second offset distance 426 may vary from the heel 116 to the toe 120 of the club head 100. For example, the second offset distance 426 may be greater toward the heel 116 of the club head 100, toward the toe 120 of the club head 100, in the center of the club head 100, or in any combination of the above described positions. The second offset distance 426 may vary from the heel 116 to the toe 120 according to any profile, such as, for example, linear, parabolic, quadratic, exponential, or any other profile.

In the illustrated embodiment, the sole transition profile 384 has a first sole radius of curvature 414 of approximately 0.40 inches (1.02 cm). In other embodiments, the first sole radius of curvature 414 may range from approximately 0.30 to 0.50 inches (0.76 to 1.27 cm). In other embodiments, the first sole radius of curvature 414 may range from approximately 0.25 to 0.50 inches (0.635 to 1.27 cm). In other embodiments still, the first sole radius of curvature 414 may range from approximately 0.25 to 0.45 inches (0.635 to 1.143 cm). For example, the first sole radius of curvature 414 may be approximately 0.25 inches (0.635 cm), 0.30 inches (0.76 cm), 0.35 inches (0.89 cm), 0.40 inches (1.02 cm), 0.45 inches (1.14 cm), or 0.50 inches (1.27 cm). For further example, the first sole radius of curvature 414 can be less than approximately 0.5 inches (1.27 cm), less than approximately 0.475 inches (1.21 cm), less than approximately 0.45 inches (1.14 cm), less than approximately 0.425 inches (1.08 cm), or less than approximately 0.40 inches (1.02 cm).

Referring to FIG. 9, in the illustrated embodiment, the first sole radius of curvature 414 and the second sole radius of curvature 424 are substantially constant from the heel 116 to the toe 120 of the club head 100. In other embodiments, the first sole radius of curvature 414 may vary from the heel 116 to the toe 120 of the club head 100. For example, the first sole radius of curvature 414 may be greater toward the heel 116 of the club head 100, toward the toe 120 of the club head 100, in the center of the club head 100, or in any combination of the above described positions. The first sole radius of curvature 414 may vary from the heel 116 to the toe 120 according to any profile, such as, for example, linear, parabolic, quadratic, exponential, or any other profile.

In other embodiments, the second sole radius of curvature 424 may vary from the heel 116 to the toe 120 of the club head 100. For example, the second sole radius of curvature 224 may be greater toward the heel 116 of the club head 100, toward the toe 120 of the club head 100, in the center of the club head 100, or in any combination of the above described positions. The second sole radius of curvature 424 may vary from the heel 116 to the toe 120 according to any profile, such as, for example, linear, parabolic, quadratic, exponential, or any other profile.

Referring to FIGS. 9 and 10, in the illustrated embodiment, the sole transition profile 384 has two transition points and two radii of curvature. In other embodiments, the sole transition profile 384 may include any number of transition points, and any number of radii of curvature. For example, the sole transition profile 384 may include one, two, three, four, five, six, seven, eight, nine, ten, or any other number of transition points. For further example, the sole transition profile 384 may include one, two, three, four, five, six, seven, eight, nine, ten, or any other number of radii of curvature.

The aerodynamic drag on a club head decreases as the first ratio of the sole transition profile approaches a value of 1.0 (i.e. as the length of the sole transition profile approaches the height of the sole transition profile, or as the height of the sole transition profile approaches the length of the sole transition profile). The first ratio of the sole transition profile 384 of the club head 100 described herein is less than the first ratio of the sole transition profile of other known golf club heads. Therefore, the club head 100 described herein has less aerodynamic drag, and therefore increased swing speeds and ball distance than other known golf club heads.

Figure 11:
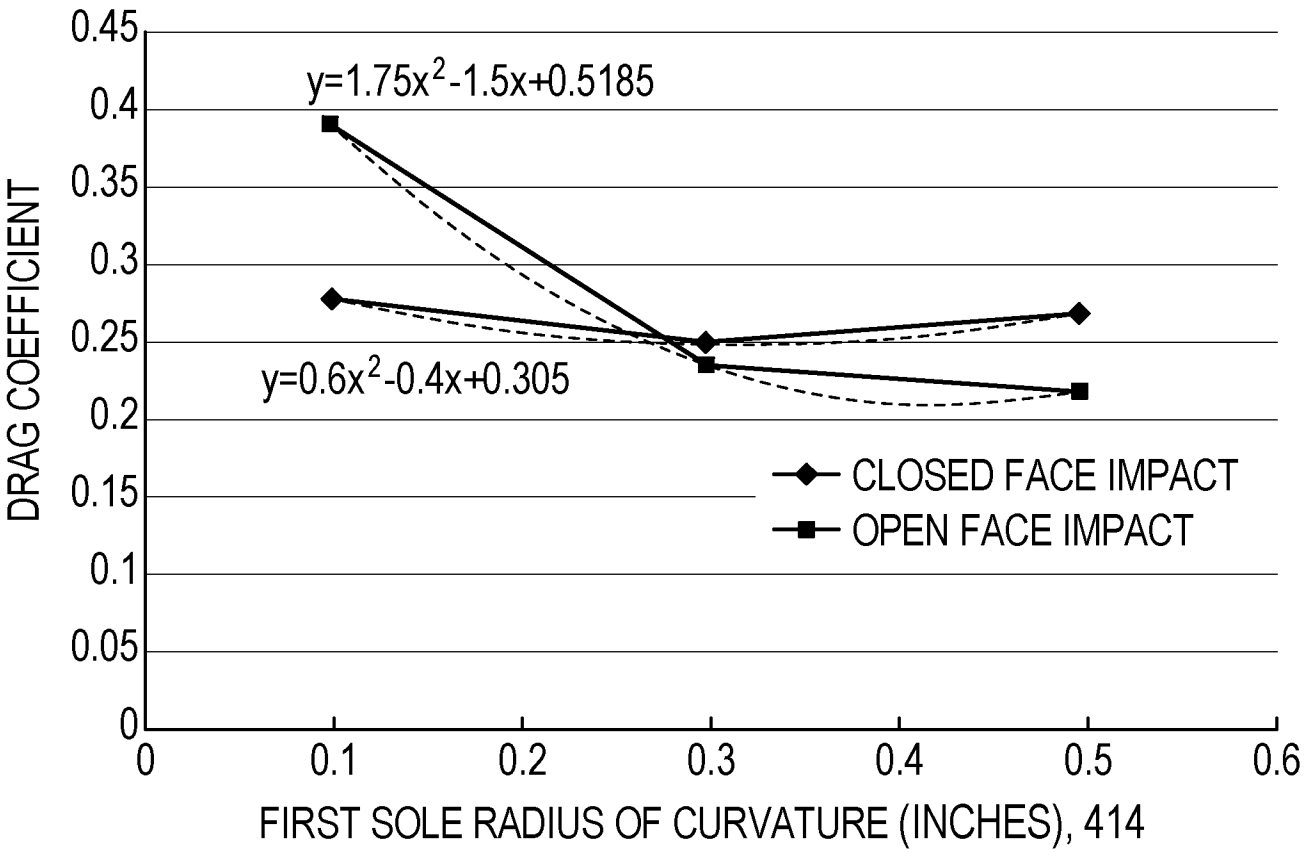
FIG. 11 illustrates a trend line of data from aerodynamic testing of exemplary golf club heads having varying sole transition profiles.

The aerodynamic drag reduction due to the first sole radius of curvature 414 was determined using wind tunnel testing for various exemplary club heads having varied first sole radii of curvature. Referring to FIG. 11, a first club head having a first sole radius of curvature of approximately 0.10 inches (0.25 cm), a second club head having a first sole radius of curvature of approximately 0.30 inches (0.76 cm), and a third club head having a first sole radius of curvature of approximately 0.50 inches (1.27 cm,) were tested in a wind tunnel. The lowest aerodynamic drag for optimal closed face impacts, measured using the drag coefficient, was observed in the second club head having the first sole radius of curvature of approximately 0.30 inches (0.76 cm). Further, in other embodiments, the lowest aerodynamic drag can be observed with a first sole radius of curvature between 0.30 inches (0.76 cm) and 0.40 inches (1.02 cm).

FIG. 11 illustrates that increasing the first sole radius of curvature does not always result in reduced drag. For example, increasing the first sole radius of curvature may result in an increase or a decrease in drag. Similarly, decreasing the first sole radius of curvature does not always result in increased drag. For example, decreasing the first sole radius of curvature may result in an increase or a decrease in drag. In the illustrated example, when the first sole radius of curvature is increased from 0.10 inches (0.25 cm) to 0.30 inches (0.76 cm), the drag is reduced by a greater extent than when the first sole radius of curvature is increased from 0.10 inches (0.25 cm) to 0.50 inches (1.27 cm) for an optimal closed face club angle at impact (i.e. 90 degrees). Further, when the first sole radius of curvature is increased from 0.30 inches (0.76 cm) to 0.50 inches (1.27 cm), the drag on the club head 100 increases for an optimal closed face club angle at impact (i.e. 90 degrees). Accordingly, an optimum first sole radius of curvature exists to reduce aerodynamic drag on the club head 100 for both an optimal closed face at impact. FIG. 11 further illustrates a curve fit to the data indicating the first sole radius of curvature between approximately 0.30 inches (0.76 cm) and 0.40 inches (1.02 cm) results in the greatest drag reduction on the club head 100 for optimal closed face angles at impact.

iii. Angles of the Sole Transition Profile

Referring to FIG. 10, the sole transition profile 384 can be further characterized by the position of the first and the second sole transition points 412, 422 in relation to the lowest point of the sole 328 and the loft plane 160. When viewed from a side cross sectional view, the sole transition profile 384 includes a first axis 450, a second axis 460, a first angle 452, and a second angle 462. The first axis 450 extends through the first sole transition point 412 and the second sole transition point 422, and forms the first angle 452 with the loft plane 160. The second axis 460 extends through the first sole transition point 412 and the lowest point of the sole 328, and forms the second angle 462 with the loft plane 160.

In the illustrated embodiment, the first angle 452 of the sole transition profile 384 ranges from approximately 95-105 degrees and the second angle 462 of the sole transition profile 384 ranges from 85-95 degrees. In other embodiments, the first angle 452 of the sole transition profile 384 may range from approximately 80-120 degrees, and the second angle 462 of the sole transition profile 384 may range from 70-120 degrees. In other embodiments, the second angle 262 of the sole transition profile 384 may be any value greater than 70 degrees, greater than 75 degrees, greater than 80 degrees, or greater than 90 degrees.

III. Rear Transition Region

Figure 12:
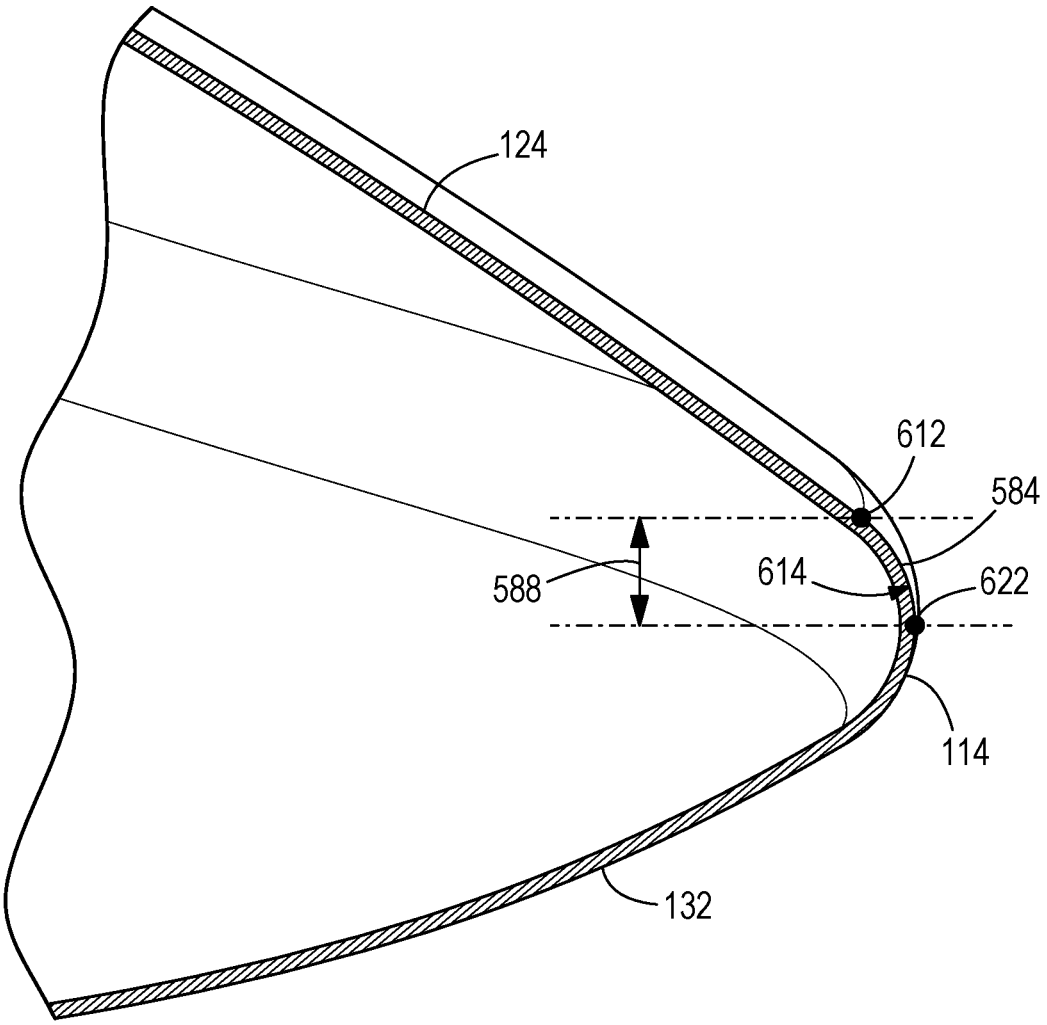
FIG. 12 is an enlarged side cross sectional view of the rear transition profile of the golf club head in FIG. 1.

Referring to FIGS. 2, 3, and 12, the rear transition region 544 extends between the crown 124 and the sole 132 of the club head 100, from near the heel 116 to near the toe 120 along the skirt or trailing edge or back end 114 of the club head 100. The rear transition region 544 includes a rear transition profile 584 when viewed from a cross sectional view. The cross sectional view can be taken at any point along the back end 114 of the club head 100 from near the heel 116 to near the toe 120. In many embodiments, the side cross sectional view of the rear transition profile 584 is taken along a plane having a varied orientation relative to the loft plane 160 depending on position relative to the heel 116 or toe 120 of the club head 100. In these or other embodiments, the cross sectional view is taken along a rear plane positioned perpendicular to the back end 114 of the club head. Specifically, in these or other embodiments, the rear plane is perpendicular to a tangent plane positioned adjacent to the back end 114 of the club head when viewed from a top view.

i. Transition Points and Radius of Curvature of the Rear Transition Profile

Referring to FIG. 12, the rear transition profile 584 further includes a rear radius of curvature 614 positioned between a first transition point 612 and a second transition point 622. In many embodiments, the first transition point 612 is located at an edge of the crown 124 near the back end 114 where the curvature of the crown 124 near the back end 114 deviates in the cross sectional view. In some embodiments, the position of the first transition point 612 can be determined using a spline method, which can indicate where the crown curvature of the club head 100 deviates to transition into the skirt or back end 114. In other embodiments, the first transition point 612 can be located on the back end 114 or skirt of the club head 100 in the cross sectional view where the rear radius of curvature 614 starts. The second transition point is located on the back end 114 or skirt of the club head in the cross sectional view where the rear radius of curvature 614 ends.

In the illustrated embodiment, the rear transition profile 584 has a rear radius of curvature 614 of approximately 0.15 inches (0.38 cm). In other embodiments, the rear radius of curvature 614 may range from approximately 0.10 to 0.25 inches (0.25 to 0.64 cm). For further example, the rear radius of curvature 614 may be approximately 0.10 inches (0.25 cm), 0.15 inches (0.38 cm), 0.20 inches (0.51 cm), or 0.25 inches (0.64 cm). For further example, the rear radius of curvature 614 can be less than approximately 0.3 inches (0.76 cm), less than approximately 0.275 inches (0.70 cm), less than approximately 0.25 inches (0.64 cm), less than approximately 0.225 inches (0.57 cm), or less than approximately 0.20 inches (0.51 cm).

In the illustrated embodiment, the rear radius of curvature 614 is substantially constant from the heel 116 to the toe 120 along the skirt or back end 114 of the club head 100. In other embodiments, the rear radius of curvature 614 may vary from the heel 116 to the toe 120 along the skirt or back end 114 of the club head 100. The rear radius of curvature 614 may be greater near the heel 116 of the club head 100, near the toe 120 of the club head 100, in the center of the skirt or back end 114 of the club head 100, or in any combination of the above described positions. For example, the rear radius of curvature 614 may be greater near the heel 116 and toe 120 of the than in the center of the back end 114 of the club head. For further example, the rear radius of curvature 614 may be greater in the center of the back end 114 of the club head than near the heel 116 and toe 120.

The rear radius of curvature 614 may vary from the heel 116 to the toe 120 according to any profile, such as, for example, linear, parabolic, quadratic, exponential, or any other profile. Further, the rear radius of curvature 614 can comprise only a portion of the rear transition region 544, such as near the heel 116 of the club head 100, near the toe 120 of the club head 100, in the center of the back end 114 of the club head 100, or in any combination of the above described positions.

In the illustrated embodiment, the rear transition profile 584 has one radius of curvature. In other embodiments, the rear transition profile 584 may include any number of any number of radii of curvature. For example, the rear transition profile 584 may include one, two, three, four, five, six, seven, eight, nine, ten, or any other number of radii of curvature.

Figure 13:
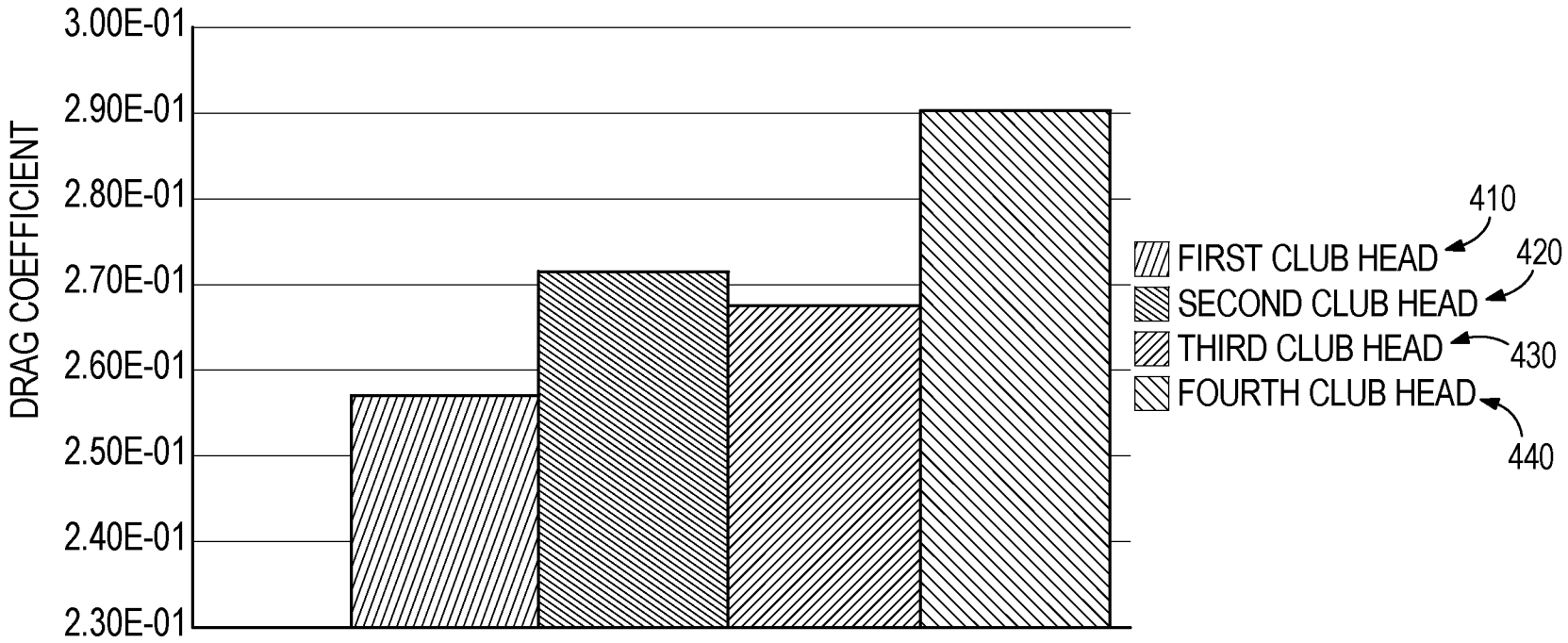
FIG. 13 illustrates data from aerodynamic testing of exemplary golf club heads having varying rear transition profiles.

The aerodynamic drag reduction due to the first rear radius of curvature 614 was determined using wind tunnel testing for various exemplary club heads having varied first rear radii of curvature. Referring to FIG. 13, a first club head 410 having a first rear radius of curvature of approximately 0.15 inches (0.38 cm), a second club head 420 having a first rear radius of curvature of approximately 0.25 inches (0.64 cm), a third club head 430 having a first rear radius of curvature of approximately 0.35 inches (0.90 cm), and a fourth club head 440 having a first rear radius of curvature of approximately 0.45 inches (1.14 cm), were tested in a wind tunnel. The lowest aerodynamic drag, measured using the drag coefficient, was observed in the first club head having the first rear radius of curvature of approximately 0.15 inches (0.38 cm). FIG. 13 illustrates that reducing the first rear radius of curvature results in reduced drag on the club head.

ii. Height of the Rear Transition Profile

Further referring to FIG. 12, in the illustrated embodiment, the rear transition profile 584 includes a height 588 measured as the distance from the first transition point 612 to the second transition point 622 in a direction parallel to the loft plane 160. In the illustrated embodiment, the height 588 of the rear transition profile 584 ranges from approximately 0.10-0.26 inches (0.25-0.66 cm). In other embodiments, the height 588 of the rear transition profile 584 may range from 0.05-0.50 inches (0.13-1.27 cm). For example, the height 588 of the rear transition profile 584 may be approximately 0.05 inches (0.13 cm), 0.10 inches (0.25 cm), 0.15 inches (0.38 cm), 0.20 inches (0.51 cm), 0.25 inches (0.64 cm), 0.30 inches (0.76 cm), 0.35 inches (0.89 cm), 0.40 inches (1.02 cm), 0.45 inches (1.14 cm), or 0.50 inches (1.27 cm).

IV. Relation of Crown, Sole, and Rear Transition Profiles

In many embodiments, the greatest reduction in aerodynamic drag resulting from the transition regions can be achieved when the club head 100 includes the crown transition profile 184 with the first crown radius of curvature 214, the sole transition profile 384 with the first sole radius of curvature 414, and the rear transition profile 584 with the rear radius of curvature 614, as described above. The illustrated embodiment of the club head 100 includes the crown transition profile 184, the sole transition profile 384, and the rear transition profile 584 to maximize aerodynamic drag reduction resulting from the crown, sole, and rear transition regions on the club head 100. In many embodiments, the crown transition profile contributes the greatest percentage to overall drag reduction on the club head 100 having the crown transition profile 184, the sole transition profile 384, and the rear transition profile 584.

The club head 100 described herein further includes various optimized relationships of the crown transition profile 184 with the first crown radius of curvature 214, the sole transition profile 384 with the first sole radius of curvature 414, and the rear transition profile 584 with the rear radius of curvature 614, to reduce aerodynamic drag on the club head 1000. In many embodiments, the first sole radius of curvature 414 is greater than the first crown radius of curvature 214, and the first crown radius of curvature 214 is greater than the rear radius of curvature 614 to reduce aerodynamic drag on the club head 100.

In the illustrated embodiment, a first ratio of the first crown radius of curvature 214 to the first sole radius of curvature 414 is approximately 0.24 inches (0.61 cm). In other embodiments, the first ratio of the first crown radius of curvature 214 to the first sole radius of curvature 414 can range from approximately 0.4-1.0, from approximately 0.5-1.0, from approximately 0.6-1.0, from approximately 0.7-1.0, from approximately 0.8-1.0, or from approximately 0.9-1.0.

In the illustrated embodiment, a second ratio of the first crown radius of curvature 214 to the rear radius of curvature 614 is approximately 1.33 inches (3.38 cm). In other embodiments, the second ratio of the first crown radius of curvature 214 to the rear radius of curvature 614 can range from approximately 1.0-3.5, from approximately 1.0-3.0, from approximately 1.0-2.5, from approximately 1.0-2.0, or from approximately 1.0-1.5.

In the illustrated embodiment, a third ratio of the first sole radius of curvature 414 to the rear radius of curvature 614 is approximately 1.5 inches (3.81 cm). In other embodiments, the third ratio of the first sole radius of curvature 414 to the rear radius of curvature 614 can range from approximately 1.0-5.0, from approximately 1.0-4.5, from approximately 1.0-4.0, from approximately 1.0-3.5, from approximately 1.0-3.0, or from approximately 1.0-2.5.

In other embodiments, the cub head can have any number of crown radii of curvature, such as one, two, three, four, or five crown radii of curvature. Further, in other embodiments, the club head can have any number of sole radii of curvature, such as one, two, three, four, or five sole radii of curvature. Further, in other embodiments, the club head can have any number of rear radii of curvature, such as one, two, three, four, or five rear radii of curvature.

The club head 100 described herein includes the crown transition profile, the sole transition profile, and the rear transition profile. In other embodiments, the club head can include one or more of the crown transition profile, the sole transition profile, or the rear transition profile, as described herein. For example, in other embodiments, the club head can have one or more of: a crown transition region having a crown transition profile with one or more crown radii of curvature, a sole transition region having a sole transition profile with one or more sole radii of curvature, or a rear transition region having a rear transition profile with one or more rear radii of curvature. While the maximum aerodynamic drag reduction due to the transition regions results when the club head includes all of the crown transition profile, the sole transition profile, and the rear transition profile, aerodynamic drag can still be reduced in embodiments where the club head includes fewer than the crown transition profile, the sole transition profile, and the rear transition profile, compared to a club head devoid of the crown transition profile, the rear transition profile, and the sole transition profile.

V. Method of Manufacturing

Figure 14:
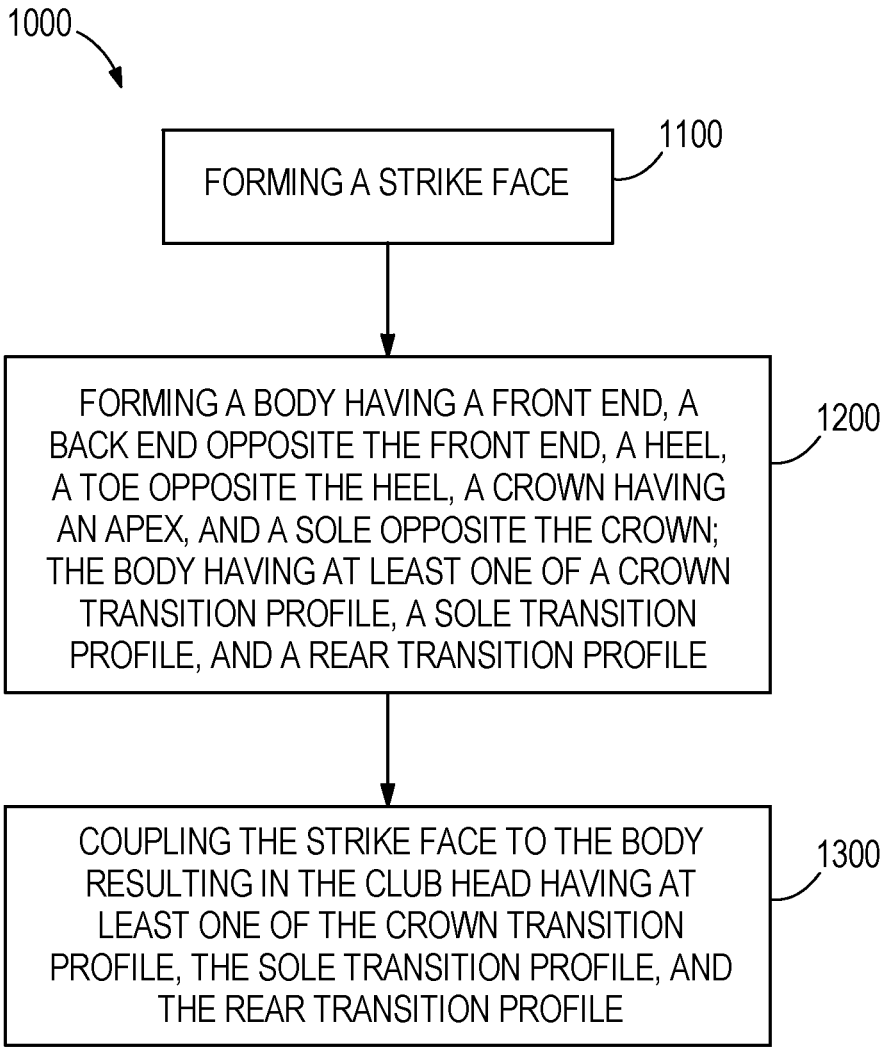
FIG. 14 illustrates a method of manufacturing the golf club head in FIG. 1.

FIG. 14 illustrates a method 1000 of manufacturing the club head 100 described herein. Block 1100 of method 1000 includes forming a strike face 108. In many embodiments, forming the strike face 108 is accomplished by machining. In other embodiments, forming the strike face 108 can be accomplished by machining, casting, forging, layer by layer printing (e.g. 3D printing), or any other suitable process.

Further referring to FIG. 14, block 1200 of method 1000 includes forming a body 104 having a front end 112, a back end 114 opposite the front end 112, a heel 116, a toe 120 opposite the heel 116, a crown 124 having an apex 128, and a sole 132 opposite the crown 124, and at least one of a crown transition region, a sole transition region or a rear transition region. In many embodiments, forming the body 104 is accomplished by casting. In other embodiments, forming the body 104 can be accomplished by machining, casting, forging, layer by layer printing (e.g. 3D printing), or any other suitable process.

Further referring to FIG. 14, block 1300 of method 1000 includes coupling the strike face 108 to the body 104 resulting in the club head 100 having at least one of the crown transition region, the sole transition region, or the rear transition region, as described herein. In many embodiments, coupling the strike face 108 to the body 104 can be accomplished by welding. In other embodiments, coupling the strike face 108 to the body 104 can be accomplished by any other suitable method.

The blocks of the method 1000 of manufacturing the club head 100 can be combined into a single block or performed simultaneously. For example, the strike face 108 and the body 104 may be formed together. Further, the method 1000 of manufacturing the club head 100 can include additional or different blocks. Other variations can be implemented for method 1000 without departing from the scope of the present disclosure.

EXAMPLES

An exemplary club head 700 comprising the crown transition profile 784 was measured for aerodynamic drag and compared against the aerodynamic drag of a control club head. The exemplary club head 700 comprised the crown transition profile 784 between the top edge of the strike face and the crown apex 728 including the first crown radius of curvature 814, the major crown transition point 825, and a plurality of curvatures 824 between the first crown transition point 812 and the crown apex 728. The first crown radius of curvature 814 was 0.24 inch. The curvature 824 between the first crown transition point 812 and the major crown transition point 825 was less than 1.5 inches (or 0.30 inch to 2.0 inches) for a major point offset distance 826 of less than 0.5 inch. Specifically, the radius of the curvature of the major crown transition point 825 at a 0.5-inch major point offset distance 826 was 1.47 inches. Further, the curvature 824 between the first crown transition point 812 and the major crown transition point 825 was less than 1.0 inches (or 0.30 to 1.0 inches) for a major point offset distance 826 of less than 0.25 inch. Further, the radius of the curvature of the major crown transition point 825 at a 0.75-inch major point offset distance 826 was 2.44 inches. Further, the plurality of crown radii of curvature between the first crown transition point 814 and the crown apex 728 was between 0.30 inch to 3.0 inches. The crown radius of curvature at the crown apex 728 was 3.0 inches.

The control club head was similar to the exemplary club head, but comprised a different crown transition profile. In general, the radii of curvature of the control club head crown transition profile were greater (i.e. less sharp) than the equivalents of the exemplary club head. The control club head comprised a first crown radius of curvature of 0.24 inch (The same as the exemplary club head). The control club head comprised a crown radius of curvature of 2.44 inches at a 0.5-inch major offset distance (as compared to the 1.47-inch radius of curvature of the exemplary club head). The control club head further comprised a crown radius of curvature of 3.66 inches at a 0.75-inch major offset distance (as compared to 2.44-inch radius of curvature of the exemplary club head). The control club head further comprised a crown radius of curvature at the crown apex of 3.5 inches (as compared to 3.0-inch radius of curvature of the exemplary club head).

The aerodynamic drag force of each club head was measured and is compared below. Wind tunnel testing was used to measure the drag force (lbf) of each club head for various air speeds (e.g. 90 mph, 100 mph, and 120 mph). The results of the wind tunnel testing are presented in Table 1 below.

TABLE 1

| Air Speed (mph) | Control Club Head Drag Force (lbf.) | Exemplary Club Head Drag Force (lbf.) |
|---|---|---|
| 90 | 0.48 | 0.45 |
| 100 | 0.57 | 0.52 |
| 120 | 0.81 | 0.76 |

As illustrated by Table 1, the exemplary club head 700 exhibited reduced drag force over the control club head. For a 90 mph air speed, the exemplary club head 700 exhibited a 0.03 lbf reduction (a 6.25% decrease) in drag force relative to the control club head. For a 100 mph air speed, the exemplary club head 700 exhibited a 0.05 lbf reduction (an 8.77% decrease) in drag force relative to the control club head. For a 120 mph air speed, the exemplary club head 700 exhibited a 0.05 lbf reduction (a 6.17% decrease) in drag force relative to the control club head.

The exemplary club head 700 comprising relatively sharp radii of curvature along the crown transition profile, particularly at locations near the crown apex 728 provides desirable aerodynamic drag reduction. The sharper crown transition profile curvatures of the exemplary club head 700 allows air to move away faster from the strike face, thus reducing drag.

CLAUSES

Clause 1: A golf club head comprising a strike face having a top edge, a bottom edge, and a geometric center, the strike face defining a loft plane positioned tangent to the strike face extending through the geometric center; and a body including a front end, a back end opposite the front end, a heel, a toe opposite the heel, a crown including and apex and a crown transition profile, the crown transition profile having a first crown radius of curvature extending from the top edge of the strike face to a first crown transition point, wherein the first crown radius of curvature is between approximately 0.18 inches and 0.30 inches, a sole including a lowest point and a sole transition profile, the sole transition profile having a first sole radius of curvature extending from the bottom edge of the strike face to a first sole transition point, wherein the first sole radius of curvature is between approximately 0.3 inches (0.76 cm) and 0.5 inches (1.27 cm), and a rear transition profile having a rear radius of curvature between approximately 0.10 inches (0.25 cm) and 0.25 inches (0.64 cm).

Clause 2: The golf club head of clause 1, wherein the crown transition profile further comprises a length measured as the perpendicular distance from the loft plane to an apex plane, and a height measured as the distance from the top edge of the strike face to a crown axis in a direction parallel to the loft plane, wherein a ratio of the length to the height of the crown transition profile is less than or equal to 3.5.

Clause 3: The golf club head of clause 2, wherein the ratio of the length to the height of the crown transition profile is less than or equal to 3.0.

Clause 4: The golf club head of clause 2, wherein the length of the crown transition profile is between 1.13-1.34 inches (2.87-3.40 cm), and the height of the crown transition profile is between 0.41-0.47 inches (1.04-1.19 cm).

Clause 5: The golf club head of clause 1, wherein the apex is offset from the loft plane by an apex distance measured in a direction perpendicular to the loft plane, the apex distance between approximately 0.8-1.4 inches (2.03-3.56 cm).

Clause 6: The golf club head of clause 1, wherein the crown transition profile further comprises a second crown radius of curvature extending from the first crown transition point to a second crown transition point, wherein the second crown radius of curvature is greater than the first crown radius of curvature.

Clause 7: The golf club head of clause 1, further comprising a heel to toe radius of curvature extending along the top edge of the strike face from near the heel to near the toe of the club head, wherein the heel to toe radius of curvature is greater than approximately 4.9 inches (12.4 cm).

Clause 8: The golf club head of clause 1, wherein the sole transition profile further comprises a length measured as the perpendicular distance from the loft plane to a sole plane, and a height measured as the distance from the bottom edge of the strike face to a sole axis in a direction parallel to the loft plane, wherein a ratio of the length to the height of the sole transition profile is less than or equal to 3.5.

Clause 9: The golf club head of clause 8, wherein the length of the sole transition profile is between 0.10-1.25 inches (0.25-3.18 cm) and the height of the sole transition profile is between 0.05-0.40 inches (0.13-1.02 cm).

Clause 10: The golf club head of clause 1, wherein the sole transition profile further comprises a second sole radius of curvature extending from the first sole transition point to a second sole transition point, wherein the second sole radius of curvature is greater than the first sole radius of curvature.

Clause 11: A golf club comprising a shaft, a grip, and a golf club head including a strike face having a top edge, a bottom edge, and a geometric center, the strike face defining a loft plane positioned tangent to the strike face extending through the geometric center, a body including, a front end, a back end opposite the front end, a heel, a toe opposite the heel, a crown including and apex and a crown transition profile, the crown transition profile having a first crown radius of curvature extending from the top edge of the strike face to a first crown transition point, wherein the first crown radius of curvature is between approximately 0.18 inches (0.46 cm) and 0.30 inches (0.76 cm), a sole including a lowest point and a sole transition profile, the sole transition profile having a first sole radius of curvature extending from the bottom edge of the strike face to a first sole transition point, wherein the first sole radius of curvature is between approximately 0.3 inches (0.46 cm) and 0.5 inches (1.27 cm), and a rear transition profile having a rear radius of curvature between approximately 0.10 inches (0.254 cm) and 0.25 inches (0.64 cm).

Clause 12: The golf club of clause 11, wherein the crown transition profile further comprises a length measured as the perpendicular distance from the loft plane to an apex plane, and a height measured as the distance from the top edge of the strike face to a crown axis in a direction parallel to the loft plane, wherein a ratio of the length to the height of the crown transition profile is less than or equal to 3.5.

Clause 13: The golf club of clause 12, wherein the ratio of the length to the height of the crown transition profile is less than or equal to 3.0.

Clause 14: The golf club head of clause 12, wherein the length of the crown transition profile is between 1.13-1.34 inches (2.87-3.40 cm), and the height of the crown transition profile is between 0.41-0.47 inches (1.04-1.19 cm).

Clause 15: The golf club of clause 11, wherein the crown transition profile further comprises a second crown radius of curvature extending from the first crown transition point to a second crown transition point, wherein the second crown radius of curvature is greater than the first crown radius of curvature.

Clause 16: The golf club of clause 11, further comprising a heel to toe radius of curvature extending along the top edge of the strike face from near the heel to near the toe of the club head, wherein the heel to toe radius of curvature is greater than approximately 4.9 inches (12.4 cm).

Clause 17: The golf club of clause 11, wherein the sole transition profile further comprises a length measured as the perpendicular distance from the loft plane to a sole plane, and a height measured as the distance from the bottom edge of the strike face to a sole axis in a direction parallel to the loft plane, wherein a ratio of the length to the height of the sole transition profile is less than or equal to 3.5.

Clause 18: The golf club of clause 17, wherein the length of the sole transition profile is between 0.10-1.25 inches (0.25-3.18 cm) and the height of the sole transition profile is between 0.05-0.40 inches (0.13-1.02 cm).

Clause 19: The golf club of clause 11, wherein the sole transition profile further comprises a second sole radius of curvature extending from the first sole transition point to a second sole transition point, wherein the second sole radius of curvature is greater than the first sole radius of curvature.

Clause 20: A method of manufacturing the golf club head of clause 1, comprising machining a strike face, casting a body having a front end, a back end opposite the front end, a heel, a toe opposite the heel, a crown having an apex and a crown transition profile, and a sole opposite the crown, coupling the strike face to the body by welding, resulting in the club head having the crown transition profile, the sole transition profile, and the rear transition profile.

Clause 21. A golf club head comprising: a strike face having a top edge, a bottom edge, and a geometric center, the strike face defining a loft plane positioned tangent to the strike face and extending through the geometric center; and a body including: a front end, a back end opposite the front end; a heel, a toe opposite the heel; a crown including a crown apex and a crown transition profile between the top edge of the strike face and the crown apex, the crown transition profile having a first crown radius of curvature extending from the top edge of the strike face to a first crown transition point, and a major crown transition point positioned between the first crown transition point and the crown apex, wherein the first crown radius of curvature is between 0.18 inch and 0.30 inch; and a plurality of crown radii of curvature between the first crown transition point and the crown apex; a rear transition profile positioned between a first transition point, and a second transition point, the rear transition profile having a rear radius of curvature between approximately 0.10 inches and 0.25 inches; wherein: the plurality of crown radii of curvature increase from the first crown transition point to the crown apex; a radius of curvature measured at the crown apex is between 2.5 inches and 3.0 inches; the major crown transition point is positioned at a major offset distance of less than 0.5 inches from the loft plane; and the plurality of crown radii of curvature between the first crown transition point and the major crown transition point are less than 2.0 inches.

Clause 22. The golf club head of clause 21, wherein the major crown transition point is positioned at the major offset distance from the loft plane of less than 0.4 inch; and wherein the plurality of crown radii of curvature between the first crown transition point and the major crown transition point are less than 1.5 inches.

Clause 23. The golf club head of clause 21, wherein the major crown transition point is positioned at the major offset distance from the loft plane of less than 0.3 inch; and wherein the plurality of crown radii of curvature between the first crown transition point and the major crown transition point are less than 1.0 inches.

Clause 24. The golf club head of clause 21, wherein the plurality of crown radii of curvature between the first crown transition point and the crown apex are between 0.30 inch to 3.0 inches.

Clause 25. The golf club head of clause 21, further comprising a crown transition region positioned between the strike face and the crown, the crown transition region including a heel to toe radius of curvature extending along the top edge of the strike face from near the heel to near the toe of the golf club head, wherein the heel to toe radius of curvature is greater than 4.9 inches.

Clause 26. The golf club head of clause 21, wherein the golf club head defines a ground plane when the golf club head is at an address position; wherein the crown apex is above the ground plane by an apex height measured perpendicular to the ground plane, the apex height is between 2 inches and 3 inches.

Clause 27. The golf club head of clause 21, wherein the crown apex is offset from the loft plane by an apex distance measured in a direction perpendicular to the loft plane, the apex distance is between 0.9 inch and 1.2 inches.

Clause 28. A golf club head comprising: a strike face having a top edge, a bottom edge, and a geometric center, the strike face defining a loft plane positioned tangent to the strike face and extending through the geometric center; and a body including: a front end, a back end opposite the front end; a heel, a toe opposite the heel; a crown including a crown apex and a crown transition profile between the top edge of the strike face and the crown apex, the crown transition profile having a first crown radius of curvature extending from the top edge of the strike face to a first crown transition point, and a major crown transition point positioned between the first crown transition point and the crown apex, wherein the first crown radius of curvature is between 0.18 inch and 0.30 inch; and a plurality of crown radii of curvature between the first crown transition point and the crown apex; a sole including a lowest point and a sole transition profile, the sole transition profile having a first sole radius of curvature extending from the bottom edge of the strike face to a first sole transition point, wherein the first sole radius of curvature is between 0.25 inches and 0.5 inches; wherein: the plurality of crown radii of curvature increase from the first crown transition point to the crown apex; a radius of curvature measured at the crown apex is between 2.5 inches and 3.0 inches; the major crown transition point is positioned at a major offset distance from the loft plane of less than 0.5 inches; and the plurality of crown radii of curvature between the first crown transition point and the major crown transition point are less than 2.0 inches.

Clause 29. The golf club head of clause 28, wherein the major crown transition point is positioned at the major offset distance from the loft plane of less than 0.4 inch; and wherein the plurality of crown radii of curvature between the first crown transition point and the major crown transition point are less than 1.5 inches.

Clause 30. The golf club head of clause 28, wherein the major crown transition point is positioned at the major offset distance from the loft plane of less than 0.3 inch; and wherein the plurality of crown radii of curvature between the first crown transition point and the major crown transition point are less than 1.0 inches.

Clause 31. The golf club head of clause 28, wherein the plurality of crown radii of curvature between the first crown transition point and the crown apex are between 0.30 inch to 3.0 inches.

Clause 32. The golf club head of clause 28, further comprising a crown transition region positioned between the strike face and the crown, the crown transition region including a heel to toe radius of curvature extending along the top edge of the strike face from near the heel to near the toe of the golf club head, wherein the heel to toe radius of curvature is greater than 4.9 inches.

Clause 33. The golf club head of clause 28, wherein the golf club head defines a ground plane when the golf club head is at an address position; wherein the crown apex is above the ground plane by an apex height measured perpendicular to the ground plane, the apex height is between 2 inches and 3 inches.

Clause 34. The golf club head of clause 28, wherein the crown apex is offset from the loft plane by an apex distance measured in a direction perpendicular to the loft plane, the apex distance is between 0.9 inch and 1.2 inches.

Clause 35. A golf club head comprising: a strike face having a top edge, a bottom edge, and a geometric center, the strike face defining a loft plane positioned tangent to the strike face and extending through the geometric center; and a body including: a front end, a back end opposite the front end; a heel, a toe opposite the heel; a crown including a crown apex and a crown transition profile between the top edge of the strike face and the crown apex, the crown transition profile having a first crown radius of curvature extending from the top edge of the strike face to a first crown transition point, and a major crown transition point positioned between the first crown transition point and the crown apex, wherein the first crown radius of curvature is between 0.18 inch and 0.30 inch, and a plurality of crown radii of curvature between the first crown transition point and the crown apex; a sole including a lowest point and a sole transition profile, the sole transition profile having a first sole radius of curvature extending from the bottom edge of the strike face to a first sole transition point, wherein the first sole radius of curvature is between 0.25 inches and 0.5 inches; a rear transition profile positioned between a first transition point, and a second transition point, the rear transition profile having a rear radius of curvature between approximately 0.10 inches and 0.25 inches; wherein: the plurality of crown radii of curvature increase from the first crown transition point to the crown apex; a crown apex radius of curvature measured at the crown apex is between 2.5 inches and 3.0 inches; the major crown transition point is positioned at a major offset distance from the loft plane of less than 0.5 inches; and the plurality of crown radii of curvature between the first crown transition point and the major crown transition point are less than 2.0 inches.

Clause 36. The golf club head of clause 35, wherein the major crown transition point is positioned at the major offset distance from the loft plane of less than 0.4 inch; and wherein the plurality of crown radii of curvature between the first crown transition point and the major crown transition point are less than 1.5 inches.

Clause 37. The golf club head of clause 35, wherein the major crown transition point is positioned at the major offset distance from the loft plane of less than 0.3 inch; and wherein the plurality of crown radii of curvature between the first crown transition point and the major crown transition point are less than 1.0 inches.

Clause 38. The golf club head of clause 35, wherein the plurality of crown radii of curvature between the first crown transition point and the crown apex are between 0.30 inch to 3.0 inches.

Clause 39. The golf club head of clause 35, wherein the golf club head defines a ground plane when the golf club head is at an address position; wherein the crown apex is above the ground plane by an apex height measured perpendicular to the ground plane, the apex height is between 2 inches and 3 inches.

Clause 40. The golf club head of clause 35, wherein the crown apex is offset from the loft plane by an apex distance measured in a direction perpendicular to the loft plane, the apex distance is between 0.9 inch and 1.2 inches.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A golfclub head, comprising:

a strike face having a top edge, a bottom edge, and a geometric center, the strike face defining a loft plane positioned tangent to the strike face and extending through the geometric center; and a body including:

a front end, a back end opposite the front end;

a heel, a toe opposite the heel;

a crown including a crown apex and a crown transition profile between the top edge of the strike face and the crown apex, the crown transition profile having a first crown radius of curvature extending from the top edge of the strike face to a first crown transition point, and a major crown transition point positioned between the first crown transition point and the crown apex, wherein the first crown radius of curvature is between 0.18 inch and 0.30 inch; a first plurality of crown radii of curvature between the first crown transition point and the major crown transition point; and a second plurality of crown radii of curvature between the major crown transition point and the crown apex;

a rear transition profile positioned between a first transition point, and a second transition point, the rear transition profile having a rear radius of curvature between approximately 0.10 inch and 0.25 inch;

wherein each radii of the first plurality of crown radii is less than each radii of the second plurality of crown radii;

a radius of curvature measured at the crown apex is between 2.5 inches and 3.0 inches;

wherein:

the golf club head defines a ground plane when the golf club head is at an address position; wherein the crown apex is above the ground plane by an apex height, measured perpendicular to the ground plane, wherein the apex height is between 2 inches and 3 inches;

the major crown transition point is positioned at a major offset distance of less than 0.5 inches from the loft plane;

the first plurality of crown radii of curvature between the first crown transition point and the major crown transition point is less than 2.0 inches; and the second plurality of crown radii of curvature between the major crown transition point and the crown apex is between 2.0 inches and 3.0 inches.

2. The golf club head of claim 1, wherein the major crown transition point is positioned at the major offset distance from the loft plane of less than 0.4 inch; and wherein the first plurality of crown radii of curvature between the first crown transition point and the major crown transition point is less than 1.5 inches.

3. The golf club head of claim 1, wherein the major crown transition point is positioned at the major offset distance from the loft plane of less than 0.3 inch; and wherein the first plurality of crown radii of curvature between the first crown transition point and the major crown transition point is less than 1.0 inch.

4. The golf club head of claim 1, further comprising a crown transition region positioned between the strike face and the crown, the crown transition region including a heel to toe radius of curvature extending along the top edge of the strike face from near the heel to near the toe of the golf club head, wherein the heel to toe radius of curvature is greater than 4.9 inches.

5. The golf club head of claim 1, wherein the crown apex is offset from the loft plane by an apex distance measured in a direction perpendicular to the loft plane, the apex distance is between 0.9 inch and 1.2 inches.

6. A golf club head, comprising:

a strike face having a top edge, a bottom edge, and a geometric center, the strike face defining a loft plane positioned tangent to the strike face and extending through the geometric center; and a body including:

a front end, a back end opposite the front end;

a heel, a toe opposite the heel;

a crown including a crown apex and a crown transition profile between the top edge of the strike face and the crown apex, the crown transition profile having a first crown radius of curvature extending from the top edge of the strike face to a first crown transition point, and a major crown transition point positioned between the first crown transition point and the crown apex, wherein the first crown radius of curvature is between 0.18 inch and 0.30 inch; a first plurality of crown radii of curvature between the first crown transition point and the major crown transition point; and a second plurality of crown radii of curvature between the major crown transition point and the crown apex;

a sole including a lowest point and a sole transition profile, the sole transition profile having a first sole radius of curvature extending from the bottom edge of the strike face to a first sole transition point, wherein the first sole radius of curvature is between 0.25 inch and 0.5 inch;

wherein each radii of the first plurality of crown radii is less than each radii of the second plurality of crown radii;

a radius of curvature measured at the crown apex is between 2.5 inches and 3.0 inches;

wherein:

the golf club head defines a ground plane when the golf club head is at an address position; wherein the crown apex is above the ground plane by an apex height, measured perpendicular to the ground plane, wherein the apex height is between 2 inches and 3 inches;

the major crown transition point is positioned at a major offset distance of less than 0.5 inch from the loft plane;

the first plurality of crown radii of curvature between the first crown transition point and the major crown transition point is less than 2.0 inches; and the second plurality of crown radii of curvature between the major crown transition point and the crown apex is between 2.0 inches and 3.0 inches.

7. The golf club head of claim 6, wherein the major crown transition point is positioned at the major offset distance from the loft plane of less than 0.4 inch; and wherein the first plurality of crown radii of curvature between the first crown transition point and the major crown transition point is less than 1.5 inches.

8. The golf club head of claim 6, wherein the major crown transition point is positioned at the major offset distance from the loft plane of less than 0.3 inch; and wherein the first plurality of crown radii of curvature between the first crown transition point and the major crown transition point is less than 1.0 inch.

9. The golf club head of claim 6, further comprising a crown transition region positioned between the strike face and the crown, the crown transition region including a heel to toe radius of curvature extending along the top edge of the strike face from near the heel to near the toe of the golfclub head, wherein the heel to toe radius of curvature is greater than 4.9 inches.

10. The golf club head of claim 6, wherein the crown apex is offset from the loft plane by an apex distance measured in a direction perpendicular to the loft plane, the apex distance is between 0.9 inch and 1.2 inches.

11. A golf club head, comprising:

a strike face having a top edge, a bottom edge, and a geometric center, the strike face defining a loft plane positioned tangent to the strike face and extending through the geometric center; and a body including:

a front end, a back end opposite the front end;

a heel, a toe opposite the heel;

a crown including a crown apex and a crown transition profile between the top edge of the strike face and the crown apex, the crown transition profile having a first crown radius of curvature extending from the top edge of the strike face to a first crown transition point, and a major crown transition point positioned between the first crown transition point and the crown apex, wherein the first crown radius of curvature is between 0.18 inch and 0.30 inch; a first plurality of crown radii of curvature between the first crown transition point and the major crown transition point; and a second plurality of crown radii of curvature between the major crown transition point and the crown apex;

a sole including a lowest point and a sole transition profile, the sole transition profile having a first sole radius of curvature extending from the bottom edge of the strike face to a first sole transition point, wherein the first sole radius of curvature is between 0.25 inch and 0.5 inch;

a rear transition profile positioned between a first transition point, and a second transition point, the rear transition profile having a rear radius of curvature between approximately 0.10 inch and 0.25 inch;

wherein each radii of the first plurality of crown radii is less than each radii of the second plurality of crown radii;

a radius of curvature measured at the crown apex is between 2.5 inches and 3.0 inches;

wherein:

the golf club head defines a ground plane when the golf club head is at an address position; wherein the crown apex is above the ground plane by an apex height, measured perpendicular to the ground plane, wherein the apex height is between 2 inches and 3 inches;

the major crown transition point is positioned at a major offset distance of less than 0.5 inch from the loft plane;

the first plurality of crown radii of curvature between the first crown transition point and the major crown transition point is less than 2.0 inches; and the second plurality of crown radii of curvature between the major crown transition point and the crown apex is between 2.0 inches and 3.0 inches.

12. The golf club head of claim 11, wherein the major crown transition point is positioned at the major offset distance from the loft plane of less than 0.4 inch; and wherein the first plurality of crown radii of curvature between the first crown transition point and the major crown transition point is less than 1.5 inches.

13. The golf club head of claim 11, wherein the major crown transition point is positioned at the major offset distance from the loft plane of less than 0.3 inch; and wherein the first plurality of crown radii of curvature between the first crown transition point and the major crown transition point is less than 1.0 inch.

14. The golf club head of claim 11, wherein the crown apex is offset from the loft plane by an apex distance measured in a direction perpendicular to the loft plane, the apex distance is between 0.9 inch and 1.2 inches.

* * * * *